US008523348B2

(12) United States Patent
Yamamoto et al.

(10) Patent No.: US 8,523,348 B2
(45) Date of Patent: Sep. 3, 2013

(54) IMAGE RECORDING APPARATUS

(75) Inventors: Hideki Yamamoto, Nagoya (JP); Yuji Sakano, Toyota (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 362 days.

(21) Appl. No.: 13/072,750

(22) Filed: Mar. 27, 2011

(65) Prior Publication Data

US 2012/0001992 A1 Jan. 5, 2012

(30) Foreign Application Priority Data

Jun. 30, 2010 (JP) ..... 2010-150547

(51) Int. Cl.
*B41J 2/01* (2006.01)

(52) U.S. Cl.
USPC ..... 347/104; 347/101

(58) Field of Classification Search
USPC ..... 346/145
See application file for complete search history.

(56) References Cited

U.S. PATENT DOCUMENTS

| | | | | |
|---|---|---|---|---|
| 4,591,884 | A * | 5/1986 | Miyamoto et al. | 347/153 |
| 4,972,236 | A * | 11/1990 | Hasegawa | 399/16 |
| 5,274,399 | A * | 12/1993 | Uchida et al. | 346/134 |
| 7,399,056 | B2 * | 7/2008 | Nakashima et al. | 347/29 |
| 8,104,888 | B2 * | 1/2012 | Sugimoto et al. | 347/104 |
| 8,162,473 | B2 * | 4/2012 | Sakano | 347/104 |
| 8,220,797 | B2 * | 7/2012 | Yamamoto et al. | 271/302 |
| 8,272,731 | B2 * | 9/2012 | Watanabe | 347/104 |
| 8,277,041 | B2 * | 10/2012 | Yamamoto | 347/104 |
| 2006/0039728 | A1 | 2/2006 | deJong et al. | |
| 2007/0008394 | A1 * | 1/2007 | Mashima | 347/104 |
| 2007/0206040 | A1 * | 9/2007 | Furuya | 347/15 |
| 2008/0211863 | A1 | 9/2008 | Chikamoto | |
| 2009/0085948 | A1 | 4/2009 | Kawamata et al. | |

(Continued)

FOREIGN PATENT DOCUMENTS

| | | | |
|---|---|---|---|
| EP | 0693381 | A1 | 1/1996 |
| EP | 1625942 | A2 | 2/2006 |

(Continued)

OTHER PUBLICATIONS

European Patent Office, extended European Search Report for European Patent Application No. 11002372.8 (counterpart European patent application), dated Oct. 4, 2012.

*Primary Examiner* — Stephen Meier
*Assistant Examiner* — Leonard S Liang
(74) *Attorney, Agent, or Firm* — Baker Botts L.L.P.

(57) ABSTRACT

An image recording apparatus including: (a) a first conveyor configured to convey a recording medium along a first conveyance path; (b) a first recording head; (c) a second conveyor configured to convey the recording medium along a second conveyance path; (d) a second recording head; (e) a third conveyor configured to convey the recording medium along a third conveyance path; and (f) a posture changer configured to change a posture of at least a downstream-side portion of the first conveyor between a first angular posture and a second angular posture, such that at least a downstream-side part of the first conveyance path is directed to the second conveyance path when the at least the downstream-side portion of the first conveyor takes the first angular posture, and such that the at least the downstream-side part of the first conveyance path is directed to the third conveyance path when the at least the downstream-side portion of the first conveyor takes the second angular posture.

13 Claims, 7 Drawing Sheets

(56) References Cited

U.S. PATENT DOCUMENTS

| | | | | |
|---|---|---|---|---|
| 2009/0141111 | A1* | 6/2009 | Yamamoto | 347/104 |
| 2009/0212484 | A1* | 8/2009 | Kawaguchi et al. | 271/195 |
| 2010/0079528 | A1* | 4/2010 | Yamamoto | 347/16 |
| 2011/0102530 | A1* | 5/2011 | Yamamoto | 347/104 |

FOREIGN PATENT DOCUMENTS

| | | | |
|---|---|---|---|
| GB | 2139193 | A | 11/1984 |
| JP | H07-330185 | A | 12/1995 |
| JP | 2004-070152 | A | 3/2004 |
| JP | 2008-213202 | A | 9/2008 |

* cited by examiner

IMAGE RECORDING APPARATUS

CROSS REFERENCE TO RELATED APPLICATION

This application claims priority from Japanese Patent Application No. 2010-150547 filed on Jun. 30, 2010, the disclosure of which is herein incorporated by reference in its entirety.

BACKGROUND OF THE INVENTION

Field of the Invention

The present invention relates to an image recording apparatus for recording an image onto a recording medium by ejecting liquid onto the recording medium, and more particularly to such an image reading apparatus that is capable of restraining an amount of consumption of the liquid without deteriorating quality of the recorded image.

There is known an inkjet printer having a plurality of inkjet heads and a conveyor belt. The inkjet heads are arranged in a conveyance direction in which a recording medium is to be conveyed, and have respective ejection surfaces through which ink is to be ejected onto the recording medium. The conveyor belt is configured to convey the recording medium, such that the recording medium is opposed to the respective ejection surfaces when the recording medium is positioned in respective positions corresponding to the respective ejection surfaces. The inkjet printer further has a maintenance unit for performing a maintenance operation onto the inkjet heads. The maintenance unit includes a tray configured to receive the ink and a wiper configured to wipe the ejection surfaces. When the maintenance operation is to be performed onto one of the inkjet heads, the inkjet heads are moved in such a direction that causes the ejection surfaces of the inkjet heads to be moved away from the conveyor belt, and then the tray is positioned in a position between the conveyor belt and the ejection surfaces of the respective inkjet heads, so as to be opposed to the ejection surfaces of the respective inkjet heads. In the maintenance operation, the ink is ejected from the inkjet heads into the tray, and then the ejection surfaces are wiped by the wiper whereby the ink adhering to the ejection surfaces is removed by the wiper.

SUMMARY OF THE INVENTION

In the above-described inkjet printer, there is a case (such as recording of a monochrome image) where an image is recorded on a recording medium while at least one of the recording heads is not ejecting ink, i.e., while at least one of the recording heads is not participating in the recording. Even in such a case, the recording medium is caused to pass a position opposed to the at least one of the recording heads that does not participate in the recording, so that foreign substances such as paper dust flutter also around the recording head or heads that do not participate in the recording. Since the foreign substances are likely to adhere to also the recording head or heads not participating in the recording, a maintenance operation has to be performed onto all the inkjet heads, thereby causing a problem that it is not possible to save an amount of ink that is be consumed in the maintenance operation.

The above problem might be solved by an image recording apparatus having first, second and third conveyors and first and second recording heads. The first conveyor is configured to convey a recording medium, and the first recording head is configured to eject liquid toward the recording medium that is being conveyed by the first conveyor. The second conveyor is configured to further convey the recording medium conveyed by the first conveyor, and the second recording head is configured to eject liquid toward the recording medium that is being conveyed by the second conveyor. The third conveyor is configured to further convey the recording medium conveyed by the first conveyor, such that the recording medium is conveyed along a conveyance path that is other than a conveyance path defined by the second conveyor. In this image recording apparatus, a flapper is provided to change the conveyance direction of the recording medium, so as to guide the recording medium toward a selected one of the second and third conveyors. The flapper is pivotable to take a selected one of first and second postures. The flapper takes the first posture when the recording medium is to be guided from the first conveyor toward the second conveyor, and takes the second posture when the recording medium is to be guided from the first conveyor toward the third conveyor. In this image recording apparatus, when being conveyed by the third conveyor, the recording medium does not pass a position opposed to the second recording head so that there is no risk that foreign substances adhere onto the ejection surface of the second recording head that does not eject the liquid and does not participate in the recording. Therefore, as long as the recording medium is conveyed by the third conveyor, there is no need to perform a maintenance operation onto the second recording head, thereby making it possible to reduce the amount of consumption of the liquid by the second recording head.

However, this image recording apparatus suffers from a problem due to an arrangement in which the third conveyor is configured to convey the recording medium along the conveyance path that is other than the conveyance path defined by the second conveyor so that the third conveyor is disposed in a position other than a position of the second conveyor. That is, the problem is that a conveyance path interconnecting the first and second conveyors or a conveyance path interconnecting the first and third conveyors has to be curved or bent. When the recording medium is to be conveyed through the bent path, the conveyance direction of the recording medium is changed by the flapper. Described specifically, the recording medium which is conveyed along the bent path is, when reaching the flapper, caused to collide at its leading end portion with the flapper, whereby the conveyance direction is abruptly changed. When the conveyance direction is thus changed, a resistance is applied to the recording medium upon collision of the leasing end portion with the flapper. This resistance, which may be referred to as "convey resistance", is a force applied to the recording medium and acting in a direction opposite to the conveyance direction, and is increased when the leading end portion of the recording medium enters into the bent path. Upon increase of the convey resistance, a velocity of the conveyed recording medium is momentarily reduced. Therefore, if the recording is continued by the first recording head onto the recording medium at the moment of change of the conveyance velocity, there is a risk that the recorded image would be disordered.

The present invention was made in view of such a background. It is therefore an object of the invention to provide an image recording apparatus in which it is possible to restrain amount of consumption of liquid and to restrain reduction of quality of recorded image by restraining momentary change of velocity of conveyed recording medium.

The above object of the invention may be achieved according to a principle of the invention, which provides an image recording apparatus including: (a) a first conveyor configured to convey a recording medium in a first conveyance direction along a first conveyance path which is defined by said first conveyor; (b) a first recording head configured to eject liquid toward the recording medium that is being conveyed by said first conveyor; (c) a second conveyor configured to convey the recording medium conveyed by said first conveyor, in a second conveyance direction along a second conveyance path which is defined by said second conveyor; (d) a second recording head configured to eject liquid toward the recording medium that is being conveyed by said second conveyor; (e) a third conveyor configured to convey the recording medium conveyed by said first conveyor, in a third conveyance direction along a third conveyance path which is defined by said third conveyor and which is other than the second conveyance path; and (f) a posture changer configured to change a posture of at least a downstream-side portion (as viewed in the first conveyance direction) of said first conveyor whereby said at least said downstream-side portion of said first conveyor is caused to take a selected one of a plurality of angular postures including a first angular posture and a second angular posture, such that at least a downstream-side part (as viewed in the first conveyance direction) of the first conveyance path defined by said at least said downstream-side portion of said first conveyor is directed to the second conveyance path when said at least said downstream-side portion of said first conveyor takes the first angular posture, and such that said at least the downstream-side part of the first conveyance path is directed to the third conveyance path when said at least said downstream-side portion of said first conveyor takes the second angular posture.

BRIEF DESCRIPTION OF THE DRAWINGS

The above and other objects, features, advantages and technical and industrial significance of the present invention will be better understood by reading the following detailed description of presently preferred embodiments of the invention, when considered in connection with the accompanying drawings, in which.

DETAILED DESCRIPTION OF THE PREFERRED EMBODIMENT

There will be described preferred embodiments of the present invention, with reference to the drawings. It is noted that, in the following description, there will be used terms "upper", "lower", "right", "left", "front" and "rear" directions of an inkjet printer 1 which are directions as seen in FIG. 1, and which are indicated by respective arrows "UP", "DOWN", "RIGHT", "LEFT", "FRONT" and "REAR" in all the drawings.

[First Embodiment]

Figure 1:
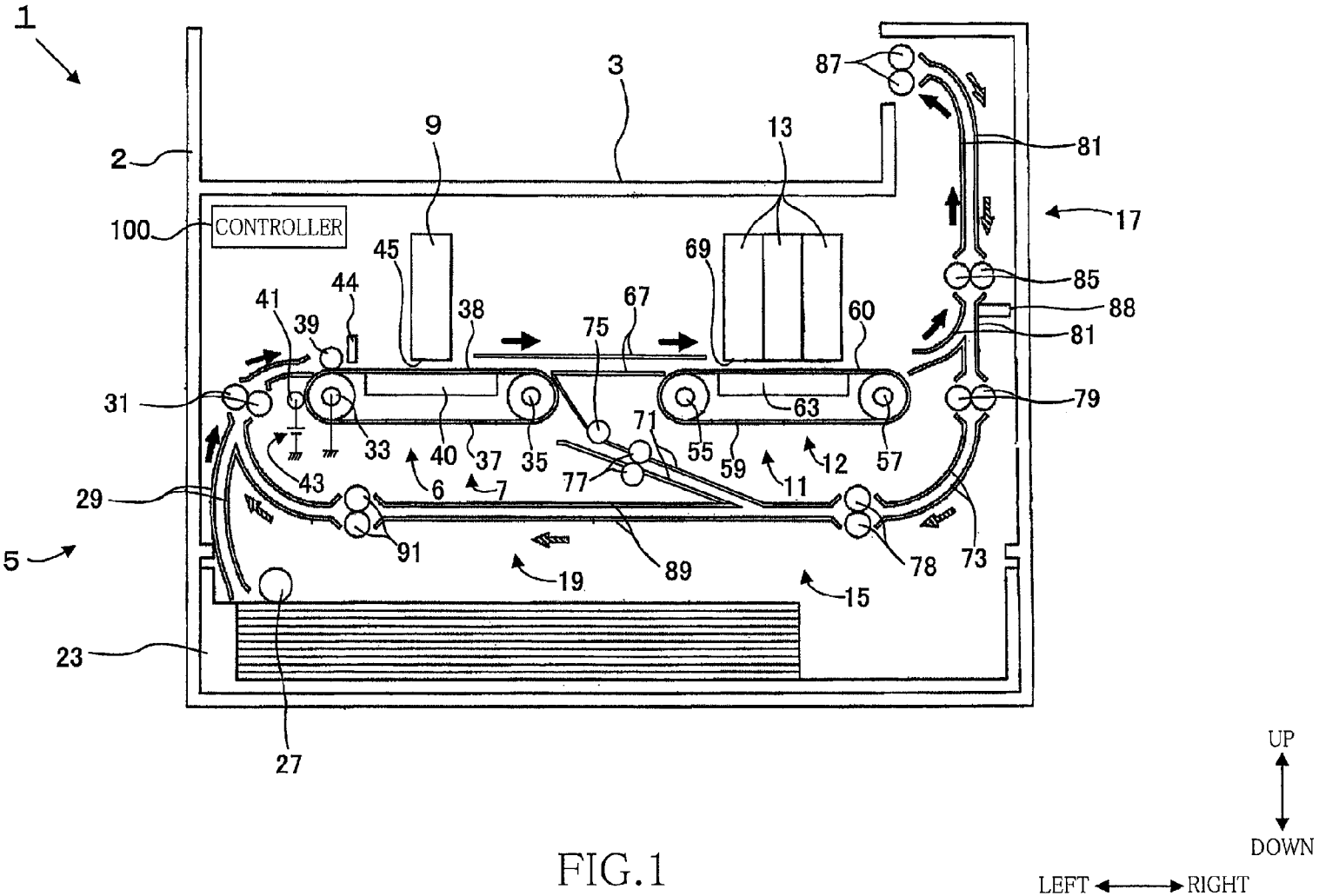
FIG. 1 is a schematic side view of an internal construction of an inkjet printer 1 according to a first embodiment of the invention, showing a state in which a first conveyor 7 takes a first angular posture.

As shown in FIG. 1, the inkjet printer 1 constructed according to the first embodiment of the invention has a generally rectangular-parallelepiped-shaped housing body 2 including an upper portion that serves as a sheet exit tray 3. Within the housing body 2, there are disposed a sheet supplier 5, a first conveyor 7, a first recording head 9, a second conveyor 11, a set of second recording heads 13, a third conveyor 15, a sheet discharger 17 and a return conveyor 19. Within the housing body 2, there are further disposed a first supporter 93 (see FIG. 4), a posture changer 21 (see FIG. 4), a second supporter 119 (see FIG. 3) and a controller 100.

There will be described components constituting the inkjet printer 1. The sheet supplier 5 is configured to supply a recording sheet as a recording medium to the first conveyor 7. The first conveyor 7 is configured to convey the sheet that has been supplied by the sheet supplier 5, in a first conveyance direction along a first conveyance path defined by the first conveyor 7. The first recording head 9 is configured to eject ink toward the sheet that is being conveyed by the first conveyor 7. The second conveyor 11 is configured to further convey the sheet conveyed by the first conveyor 7, in a second conveyance direction along a second conveyance path defined by the second conveyor 11. The second recording heads 13 are configured to eject inks toward the sheet that is being conveyed by the second conveyor 11. The third conveyor 15 is configured to further convey the sheet conveyed by the first conveyor 7, in a third conveyance direction along a third conveyance path which is defined by the third conveyor 15 and which is other than the second conveyance path. The sheet discharger 17 is configured to discharge the sheet conveyed by the second conveyor 11 or third conveyor 15, toward the sheet exit tray 3. The return conveyor 19 is configured to convey or return the sheet (conveyed by the sheet discharger 17 in an opposite direction opposite to a discharging direction) to the first conveyor 7. The first supporter 93 is provided to support the first conveyor 7 and the first recording head 9 (see FIG. 4). The posture changer 21 is configured to change an angular postures of the first conveyor 7 and the first recording head 9, by causing the first supporter 93 to be pivoted (see FIG. 4). The second supporter 119 is provided to support the second conveyor 11 and the second recording heads 13 (see FIG. 3). The controller 100 is configured to control activations of some of the these components, i.e., the sheet supplier 5, first conveyor 7, first recording head 9, second conveyor 11, second recording heads 13, third conveyor 15, sheet discharger 17, return conveyor 19 and posture changer 21. Each of these components of the inkjet printer 1 will be described below in detail.

<Main Frame 4>

Figure 3:
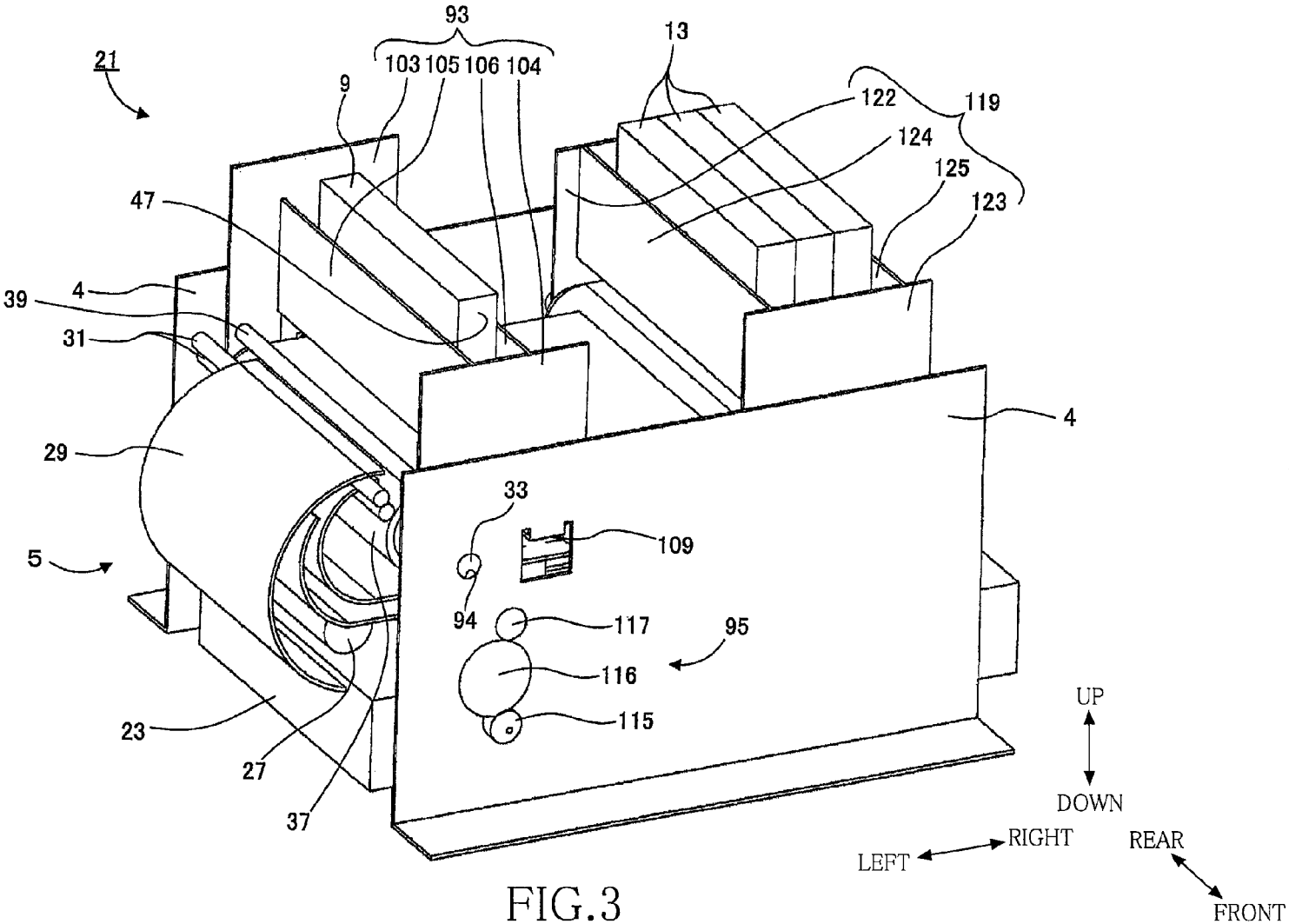
FIG. 3 is a perspective view of the internal construction of the inkjet printer 1.

As shown in FIG. 3, a main frame 4 is disposed within the housing body 2. The main frame 4 is constituted by a pair of plates consisting of a front-side plate and a rear-side plate. The main frame 4 supports the above-described components, i.e., the sheet supplier 5, first conveyor 7, first recording head 9, second conveyor 11, second recording heads 13, third conveyor 15, sheet discharger 17, return conveyor 19, first supporter 93, posture changer 21 and second supporter 119. Each of the plates of the main frame 4 has a through-hole 94 in which a shaft of a belt pulley 33 is to be introduced. Each of the plates of the main frame 4 further has through-holes (not shown) in which shafts of respective belt pulleys 55, 57 are introduced. The front-side plate of the main frame 4 is provided with a support plate 109 to which a biasing or forcing portion 101 is attached. The support plate 109 is formed integrally with the front-side plate of the main frame 4, and protrudes rearwardly from the front-side plate.

<Sheet Supplier 5>

As shown in FIG. 1, the sheet supplier 5 includes a sheet supplying cassette 23, a sheet supplying roller 27, a conveying guide 29 and a pair of conveying rollers 31.

The sheet supplying cassette 23 is removably disposed in a lower portion of the housing body 2, and is capable of accommodating a plurality of sheets stacked therein. The sheet supplying cassette 23 has a box-like shape, and opens upwardly.

The sheet supplying roller 27 is disposed in an upper portion of the sheet supplying cassette 23, and is rotatably held by the main frame 4. The sheet supplying roller 27 is arranged to be in contact with an uppermost one of the sheets accommodated in the sheet supplying cassette 23. The sheet supplying roller 27 is to be rotated by a motor (not shown) when the motor receives, from the controller 100, a command requesting of rotation of the sheet supplying roller 27. With rotation of the sheet supplying roller 27 that is contact with the uppermost sheet, the uppermost sheet is supplied to the conveying guide 29.

The conveying guide 29 is fixed to the main frame 4, and is disposed on an upper-left side of the sheet supplying cassette 23. The conveying guide 29 extends curvedly from the cassette 23 in an upward direction, so as to guide the sheet supplied from the sheet supplying cassette 23, upwardly toward the first conveyor 7.

The pair of conveying rollers 31 are disposed on halfway of the conveying guide 29, and are rotatably held by the main frame 4. One of the conveying rollers 31 is a drive roller that is to be rotated by a motor (not shown) when the motor receives, from the controller 100, a command requesting rotation of the drive roller. The other of the conveying rollers 31 is a driven roller that is to be rotated together with rotation of the drive roller. The pair of conveying rollers 31 serve to convey the sheet that is being guided by the conveying guide 29, toward the first conveyor 7.

<First Supporter 93>

Figure 4:
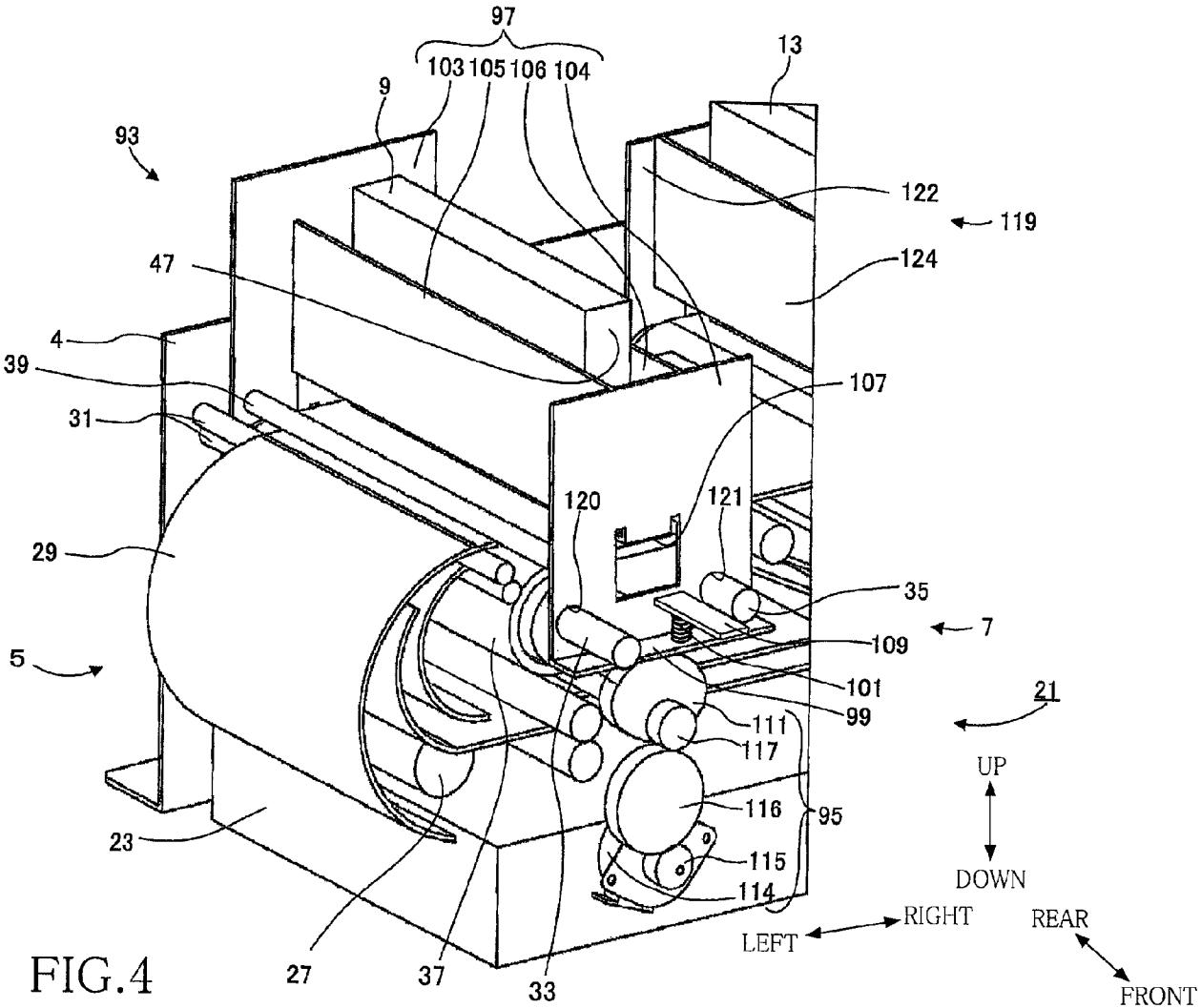
FIG. 4 is a perspective view of the internal construction of the inkjet printer 1, showing the first conveyor 7, a first recording head 9 and a posture changer 21, with a front-side one of plates constituting a main frame 4 being cut away for clarity.

As shown in FIG. 4, the first supporter 93 supports the first conveyor 7 and the first recording head 9. Although FIG. 4 is a perspective view with the front-side plate of the main frame 4 being cut away, the support plate 109 integrally formed with the front-side plate of the main frame 4 is shown for easier understanding.

As shown in FIG. 3, the first supporter 93 is pivotably held by the main frame 4. Described specifically, the first supporter 93 is held by the main frame 4 via the belt pulley 33, and is pivotable about an axis of the belt pulley 33 by the posture changer 21. With pivot motion of the first supporter 93, the angular postures of the first conveyor 7 and the first recording head 9 is changed. As shown in FIG. 4, the first supporter 93 has a set of walls 97 and a contact portion 99. The set of walls 97 consist of four walls 103, 104, 105, 106.

The walls 103, 104 are plate-like members disposed in rear and front portions of the first supporter 93, respectively, and is located inside the pair of plates of the main frame 4. The belt conveyor unit 6 and the first recording head 9 are located between the walls 103, 104, and are sandwiched by the walls 103, 104 from the rear and front sides.

Each of the walls 103, 104 has the through-holes 120, 121 in which the shafts of the respective belt pulleys 33, 35 are introduced. The shaft of the belt pulley 33 is introduced in the through-holes 120 of the walls 103, 104 and the through-holes 94 of the main frame 4, so that the first supporter 93 is pivotable about the axis of the belt pulley 33.

Figure 5:
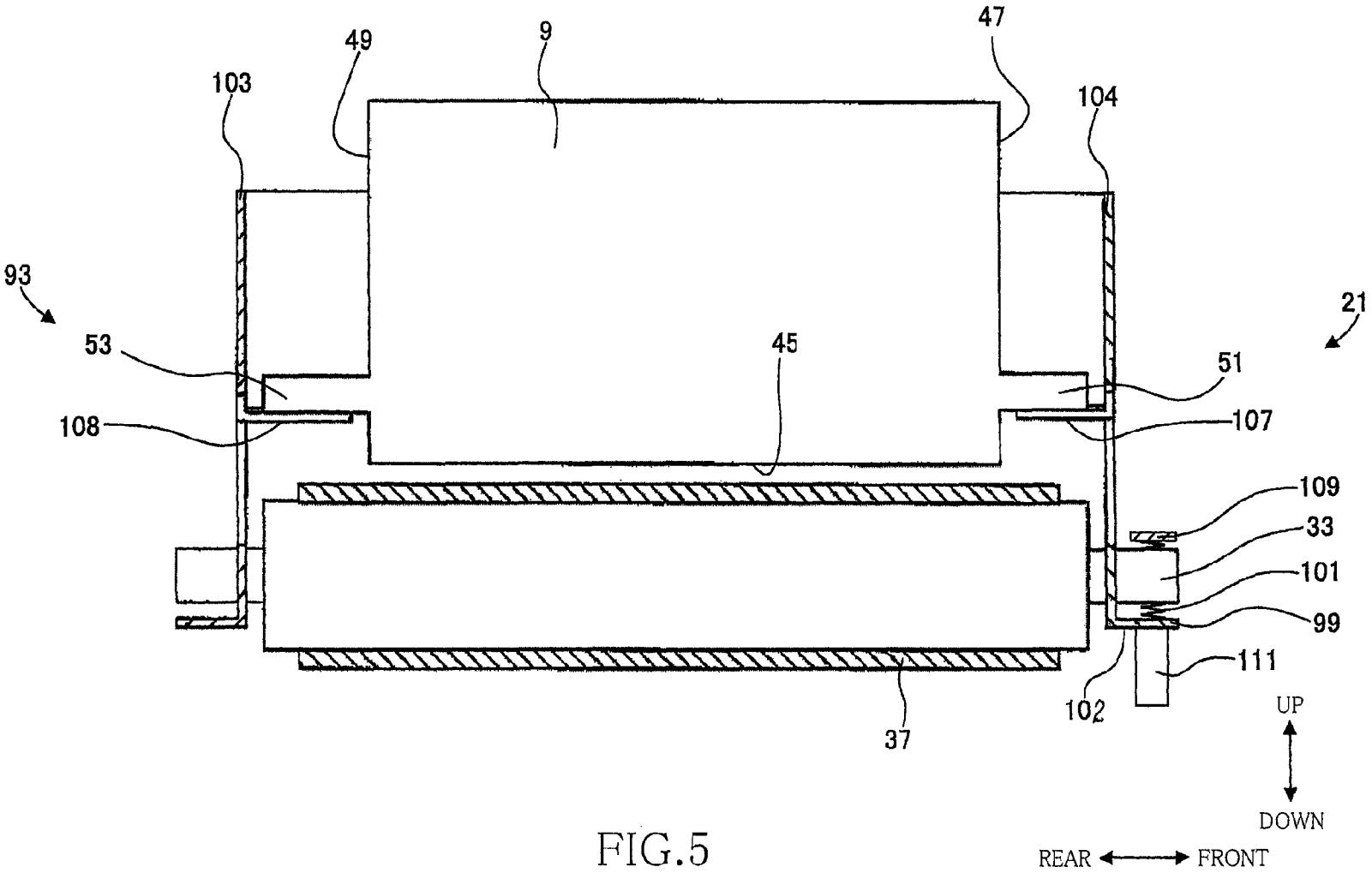
FIG. 5 is a partially cross-sectional view of a first supporter 93 of the inkjet printer 1, as seen from a left side of the first supporter 93.

As shown in FIG. 5, supporting projections 107, 108 are provided in the respective walls 103, 104, and project inwardly from the respective walls 103, 104. The supporting projections 107, 108 cooperate to support the first recording head 9.

The wall 104, which is disposed in the front portion of the first supporter 93, is provided with the contact portion 99. The contact portion 99 projects forwardly from a lower end portion of the wall 104, and has a lower surface 102, as shown in FIG. 5. The lower surface 102 of the contact portion 99 is in contact with an upper surface (i.e., an upper portion of a circumferential cam surface) of a eccentric cam 111. With rotation of the eccentric cam 111, the contact portion 99 is displaced upwardly or downwardly, whereby the first supporter 93 is pivoted.

The walls 105, 106 are plate-like members extending and interconnecting the walls 103, 104. The first recording head 9 is sandwiched by the walls 105, 106 from the left and right sides.

<First Conveyor 7>

Figure 2:
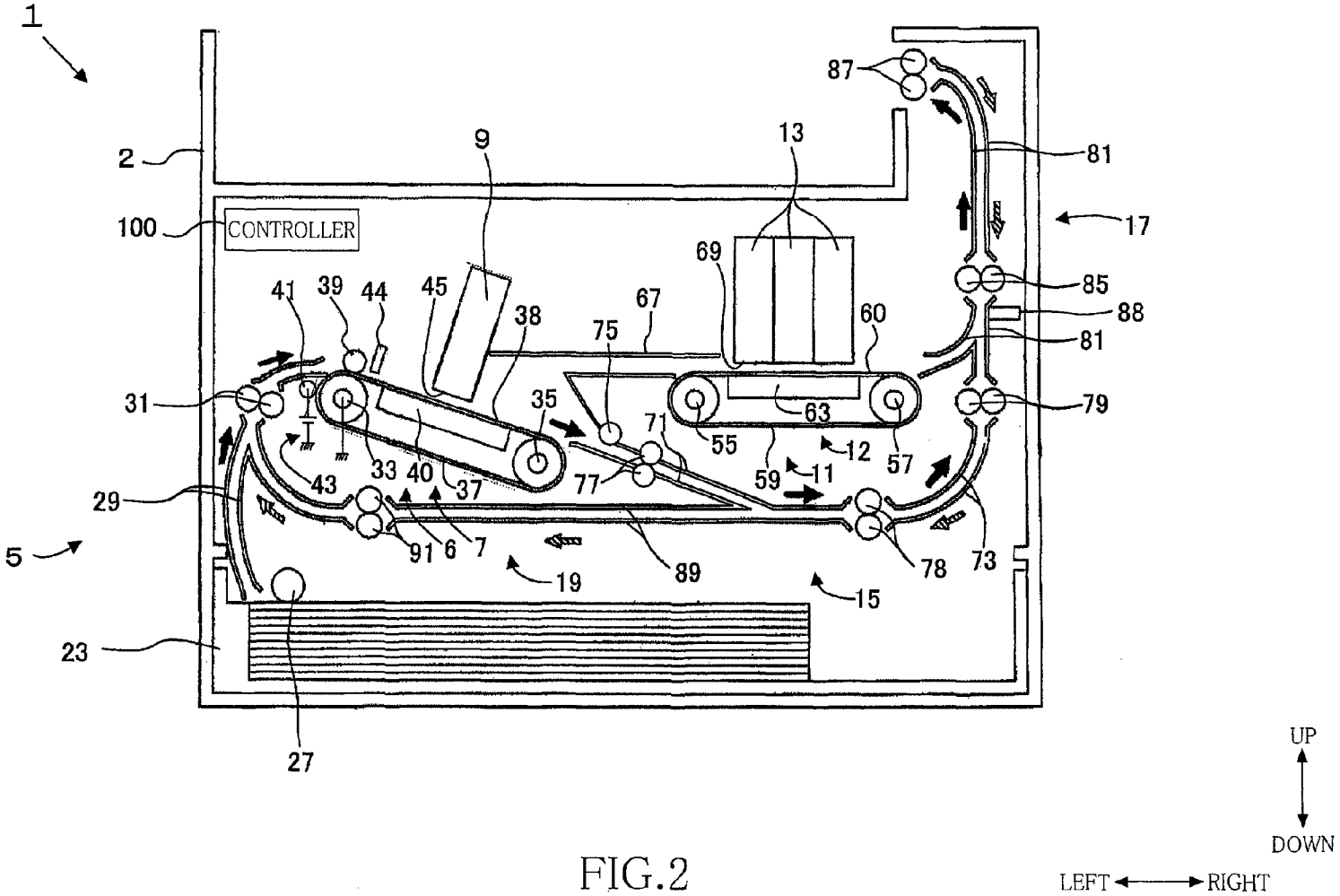
FIG. 2 is a schematic side view of the internal construction of the inkjet printer 1, showing a state in which the first conveyor 7 takes a second angular posture.

As shown in FIGS. 1 and 2, the first conveyor 7 is configured to convey the sheet that has been supplied by the sheet supplier 5, in a rightward direction. The first conveyor 7 is constituted by the single belt-conveyor unit 6 which has, in addition to the above-described belt pulleys 33, 35, a conveyor belt 37, a platen 40, a pressing roller 39 and a first charge roller 41. The belt conveyor unit 6 except the first charge roller 41 is fixed to the first supporter 93. The angular posture of the belt conveyor unit 6 is changed as a result of pivot motion of the first supporter 93, so that the first conveyor 7 takes a selected one of a plurality of angular postures including a first angular posture shown in FIG. 1 and a second angular posture shown in FIG. 2.

As shown in FIG. 1, the belt pulleys 33, 35 are arranged in a right-left direction, and extend in a front-rear direction. The belt pulley 33, which is a left-side one of the belt pulleys 33, 35, is a drive pulley that is to be rotated by a motor (not shown) when the motor receives, from the controller 100, a command requesting of rotation of the belt pulley 33. The belt pulley 35, which is a right-side one of the belt pulleys 33, 35, is a driven pulley. That is, the driven pulley is provided by an upstream-side one, as viewed in the first conveyance direction, of the belt pulleys 33, 35. The shaft of the belt pulley 33 is connected to ground. The belt pulley 33 is rotated by a driving force of the motor, in clockwise direction as seen in FIG. 1. The belt pulley 35 is rotated by rotation of the belt pulley 33 which is transmitted thereto via the conveyor belt 37, in the clockwise direction as seen in FIG. 1.

As shown in FIG. 4, the shaft of the belt pulley 33 is rotatably introduced in the through-holes 120 that are formed in the walls 103, 104 of the first supporter 93. The shaft of the belt pulley 33 is rotatably introduced in the through-hole 94 that is formed in the main frame 4. Meanwhile, the shaft of the belt pulley 35 is rotatably introduced in the through-holes 121 that are formed in the walls 103, 104 of the first supporter 93.

The conveyor belt 37 is an endless belt that is stretched around the two belt pulleys 33, 35. When the belt pulley 33 is rotated by the driving force of the motor in the clockwise direction as seen in FIG. 1, an upper-side surface of the conveyor belt 37, which is opposed to the first recording head 9, is caused to run in the rightward direction as seen in FIG. 1. This upper-side surface is provided by an upper portion of the outer circumferential surface of the conveyor belt 37, and constitutes a supporting surface 38 defines the first conveyance path along which the sheet is to be conveyed by the first conveyor 7. That is, the supporting surface 38 supports the sheet held thereon, and the conveyor belt 37 is circulated for thereby conveying the sheet in the rightward direction.

The platen 40 is fixed to the first supporter 93, and is disposed to be in contact with an upper portion of an inner circumferential surface of the conveyor belt 37, so as to support the conveyor belt 37. Owing to the platen 40, the supporting surface 38 of the conveyor belt 37 keeps a flat shape.

The pressing roller 39 is disposed on an upper side of the belt pulley 33, and is held in contact with the outer circumferential surface of the conveyor belt 37. The pressing roller 39 serves to press the sheet (that has been guided by the conveying guide 29) down onto the conveyor belt 37. A sheet sensor 44 is disposed on a downstream side, as viewed in the conveyance direction, of the pressing roller 39. The sheet sensor 44 is configured to detect the sheet that is conveyed by the conveyor belt 37, and supplies, to the controller 100, a signal indicative of detection of the sheet. The pressing roller 39 and the sheet sensor 44 are supported by the first supporter 93.

The first charge roller 41 is disposed on a left side of the belt pulley 33, and is held in contact with the outer circumferential surface of the conveyor belt 37. The first charge roller 41 is rotatably held by the main frame 4. The first charge roller 41 includes a shaft (about which the first charge roller 41 is to be rotated) that is made of a metallic material, and an outer peripheral portion that is made of an elastic material having insulating properties or semi-conducting properties. The shaft of the first charge roller 41 is connected to a positive pole of a first direct-current source 43 that is to be activated when the source 43 receives, from the controller 100, a command requesting of activation of the source 43. A negative pole of the source 43 is connected to ground. It is noted that the first charge roller 41 may be supported by the first supporter 93.

When a predetermined level of electric voltage is applied to the shaft of the first direct-current source 43, an electrical discharge is generated between the first charge roller 41 and the conveyor belt 37. By the electrical discharge from the first charge roller 41, the conveyor belt 37 is charged with a positive charge. When the sheet is guided by the conveying guide 29 to the conveyor belt 37, the sheet is pressed, by the pressing roller 30, onto the conveyor belt 37. Since the conveyor belt 37 is charged with the positive charge as a result of the electrical discharge from the first charge roller 41, a surface of the sheet, which is held in contact with the conveyor belt 37, is charged with a negative charge, so that the sheet is attracted onto the conveyor belt 37. Thus, by circulating the conveyor belt 37 onto which the sheet is attracted, the sheet is conveyed along the first conveyance path that is defined by the supporting surface 38 of the conveyor belt 37, in the rightward direction as seen in FIG. 1. In the present embodiment, the belt pulley 33, first charge roller 41 and first direct-current source 43 cooperate to constitute an attraction generating device that is configured to cause the sheet to be attracted to the conveyor belt 37.

As described above, the belt conveyor unit 6 (constituting the first conveyor 7) except the first charge roller 41 is supported by the first supporter 93. The first supporter 93 is held by the main frame 4 via the belt pulley 33, and is pivotable about the axis of the belt pulley 33. By pivot motion of the first supporter 93, the posture of the first conveyor 7 is changed between the first angular posture and the second angular posture. When the first conveyor 7 takes the first angular posture as shown in FIG. 1, the belt pulley 35 is positioned in the same height position as the belt pulley 33, and the supporting surface 38 of the conveyor belt 37 is parallel to a horizontal plane. Thus, the sheet conveyed by the conveyor belt 37 is moved along the horizontal plane in the rightward direction. On the other hand, when the first conveyance path takes the second angular posture as shown in FIG. 2, the belt pulley 35 is positioned in a position lower than the belt pulley 33, and the supporting surface 38 of the conveyor belt 37 is inclined with respect to a horizontal plane, in a right downward direction. Thus, the sheet conveyed by the conveyor belt 37 is moved in the right downward direction.

<First Recording Head 9>

The first recording head 9 is to be activated, when the first recording head 9 receives, from the controller 100, a command requesting of activation of the head 9, for thereby ejecting ink toward the sheet that is being conveyed by the first conveyor 7. The first recording head 9 is a black recording head that is configured to eject black ink toward the sheet. The first recording head 9 is a generally rectangular-parallelepiped-shaped head, as shown in FIG. 3, and is configured to eject the black ink having supplied from a black ink tank (not shown) storing the black ink, toward the sheet through a plurality of nozzles that open in a nozzle opening surface (i.e., ejection surface) 45 of the head 9. As shown in FIG. 1, the nozzle opening surface 45 constitutes a bottom surface of the head 9.

The first recording head 9 is supported by the first supporter 93 such that the nozzle opening surface 45 of the head 9 and the supporting surface 38 of the conveyor belt 37 are opposed to each other with a predetermined distance therebetween. Specifically, as shown in FIG. 5, the first recording head 9 has a front surface 47 and a rear surface 49, and the front and rear surfaces 47, 49 have first projecting portions 51, 53, respectively, which extend outwardly. The first projecting portions 51, 53 are fixed to the above-described supporting projections 107, 108 of the first supporter 93, respectively, whereby the first recording head 9 is supported by the first supporter 93.

An angular posture of the first recording head 9 is changed by pivot motion of the first supporter 93, namely, the first recording head 9 is pivoted together with the pivot motion of the first supporter 93, such that a distance between the nozzle opening surface 45 of the first recording head 9 and the supporting surface 38 of the conveyor belt 37 is held constant irrespective of change of the angular posture of the first conveyor 7. Specifically, when the first conveyor 7 takes the first angular posture, as shown in FIG. 1, the nozzle opening surface 45 of the first recording head 9 is parallel to a horizontal plane, namely, parallel to the supporting surface 38 of the conveyor belt 37. On the other hand, when the first conveyor 7 takes the second angular posture, the nozzle opening surface 45 of the first recording head 9 is inclined with respect to a horizontal plane, in a right downward direction, so as to be parallel to the supporting surface 38 of the conveyor belt 37. Thus, irrespective of change of the angular posture of the first conveyor 7, the nozzle opening surface 45 and the supporting surface 38 are distant from each other by a predetermined distance that can be held constant so that an image recording by the first recording head 9 can be carried out with stability. The predetermined distance is a distance which is suitable for carrying out the image recording, namely, a distance which is suitable for avoiding a recorded surface of the sheet from being brought into contact with the nozzle opening surface 45 and which is suitable for enabling ink droplets to be accurately placed in desired positions.

<Second Supporter 119>

As shown in FIG. 3, the second supporter 119 supports the second conveyor 11 and the set of second recording heads 13.

The second supporter 119 is fixed to the main frame 4. Like the first supporter 93, the second supporter 119 has a set of walls which are provided by plate-like members. The set of walls of the second supporter 119 consist of four walls 122, 123, 124, 125.

The walls 122, 123 are disposed between the front-side plate and rear-side plate of the main frame 4. The belt conveyor unit 12 (see FIG. 1) and the second recording heads 13 are located between the walls 122, 123, and are sandwiched by the walls 122, 123 from the rear and front sides.

Each of the walls 122, 123 has through-holes (not shown) in which shafts of the respective belt pulleys 55, 57 are introduced. The shaft of the respective belt pulleys 55, 57 are rotatably introduced in the through-holes (not shown) of the walls 122, 123 and through-holes (not shown) of the main frame 4.

Like in the above-described walls 103, 104, supporting projections (not shown) are provided in the respective walls 122, 123, and project inwardly from the respective walls 122, 123. The supporting projections cooperate to support the set of second recording heads 13.

The walls 124, 125 are plate-like members extending and interconnecting the walls 122, 123. The second recording heads 13 are sandwiched by the walls 124, 125 from the left and right sides.

<Second Conveyor 11>

The second conveyor 11 is configured to convey the sheet (conveyed by the first conveyor 7 when the first conveyor 7 takes the first angular posture) further in the rightward direction as seen in FIG. 1. The sheet, which is conveyed by the first conveyor 7 and the second conveyor 11, is moved along bold arrows (black arrows) in FIG. 1. The second conveyor 11 is constituted by the single belt conveyor unit 12. Like the belt conveyor unit 6, the belt conveyor unit 12 includes, in addition to the above-described belt pulleys 55, 57, a conveyor belt 59, a platen 63 and a second charge roller (not shown). The belt conveyor unit 12 is held by the main frame 4 via the second supporter 119. When the first conveyor 7 takes the first angular posture, the belt conveyor unit 6 and the belt conveyor unit 12 are interconnected via a conveying guide 67 that extends along a horizontal plane, so that the conveying guide 67 serves to guide the sheet (conveyed by the belt conveyor unit 6) toward the belt conveyor unit 12. The conveying guide 67 is fixed to the main frame 4.

The belt pulleys 55, 57 are arranged in the right-left direction, and extend in the front-rear direction. The belt pulleys 55, 57 are both positioned in the same height position as the belt pulley 33. That is, the height positions of the respective belt pulleys 55, 57 are same to each other, and are same to the height position of the belt pulley 33. The belt pulley 55, which is a left-side one of the belt pulleys 55, 57, is a drive pulley that is to be rotated by a motor (not shown) when the motor receives, from the controller 100, a command requesting of rotation of the belt pulley 55. The belt pulley 57, which is a right-side one of the belt pulleys 55, 57, is a driven pulley. The shaft of the belt pulley 55 is connected to ground. The belt pulley 55 is rotated by a driving force of the motor, in clockwise direction as seen in FIG. 1. The shafts of the respective belt pulleys 55, 57 are introduced in through-holes of the walls 122, 123 of the second supporter 119 and also in through-holes of the main frame 4.

The conveyor belt 59 is an endless belt that is stretched around the two belt pulleys 55, 57. When the belt pulley 55 is rotated by the driving force of the motor in the clockwise direction as seen in FIG. 1, an upper-side surface of the conveyor belt 59, which is opposed to the set of second recording heads 13, is caused to run in the rightward direction as seen in FIG. 1. This upper-side surface is provided by an upper portion of the outer circumferential surface of the conveyor belt 59, and constitutes a supporting surface 60 defines the second conveyance path along which the sheet is to be conveyed by the second conveyor 11. That is, the supporting surface 60 supports the sheet held thereon, and the conveyor belt 59 is circulated for thereby conveying the sheet in the rightward direction. Since the supporting surface 60 of the conveyor belt 59 is parallel to a horizontal plane, the sheet conveyed by the conveyor belt 59 is moved along the horizontal plane.

The platen 63 is fixed to the second supporter 119, and is disposed to be in contact with an upper portion of an inner circumferential surface of the conveyor belt 59, so as to support the conveyor belt 59. Owing to the platen 63, the supporting surface 60 of the conveyor belt 59 keeps a flat shape.

The second charge roller (not shown) has substantially the same construction as the first charge roller 41. The second charge roller is disposed in proximity with the belt pulley 55, and is held in contact with the outer circumferential surface of the conveyor belt 59. The second charge roller is rotatably supported by the second supporter 119. The second charge roller includes a shaft (about which the second charge roller is to be rotated) that is made of a metallic material, and an outer peripheral portion that is made of an elastic material having insulating properties or semi-conducting properties. The shaft of the second charge roller is connected to a positive pole of a second direct-current source (not shown) that is to be activated when the second direct-current source receives, from the controller 100, a command requesting of activation of the second direct-current source. A negative pole of the second direct-current source is connected to ground.

When a predetermined level of electric voltage is applied to the shaft of the second direct-current source, an electrical discharge is generated between the second charge roller and the conveyor belt 59. By the electrical discharge from the second charge roller, the conveyor belt 59 is charged with a positive charge. When the sheet is conveyed from the conveying guide 67 to the conveyor belt 59, the sheet is attracted onto the conveyor belt 59. Thus, by circulating the conveyor belt 59 to which the sheet is attracted, the sheet is conveyed along the second conveyance path that is defined by the supporting surface 60 of the conveyor belt 59, in the rightward direction as seen in FIG. 1. In the present embodiment, the belt pulley 55, second charge roller and second direct-current source cooperate to constitute another attraction generating device that is configured to cause the sheet to be attracted to the conveyor belt 59.

<Second Recording Heads 13>

The second recording heads 13 are to be activated, when the second recording heads 13 receive, from the controller 100, a command requesting of activation of the heads 13, for thereby ejecting inks toward the sheet that is being conveyed by the second conveyor 11. The second recording heads 13 consist of three color recording heads that are configured to eject magenta, cyan and yellow inks toward the sheet. Each of the second recording heads 13 is a generally rectangular-parallelepiped-shaped head, as shown in FIG. 3, and is configured to eject ink having supplied from a corresponding one of three ink tanks (not shown) storing the respective magenta, cyan and yellow inks, toward the sheet through a plurality of nozzles that open in a nozzle opening surface 69 of the head. As shown in FIG. 1, the nozzle opening surface 60 constitutes a bottom surface of each of the second recording heads 13.

As shown in FIG. 1, the second recording heads 13 are supported by the second supporter 119 such that the nozzle opening surface 69 of each of the heads 13 and the supporting surface 60 of the conveyor belt 50 are opposed to each other with a predetermined distance therebetween. Specifically, the set of second recording heads 13 has a front surface and a rear surface, and the front and rear surfaces have second projecting portions (not shown) which extend outwardly. Similarly as the above-described first projecting portions 51, 53, the second projecting portions are fixed to supporting projections of the second supporter 119, respectively, whereby the set of second recording heads 13 is supported by the second supporter 119.

<Third Conveyor 15>

As shown in FIG. 2, the third conveyor 15 is configured to convey the sheet (conveyed by the first conveyor 7 when the first conveyor 7 takes the second angular posture) further in the rightward direction, along a third conveyance path that is other than the second conveyance path defined by the second conveyor 11. The third conveyor 15 is configured to convey the sheet, by causing the sheet to bypass the second conveyor 11. That is, the third conveyance path defined by the third conveyor 15 is a bypass that bypasses the second conveyance path. The sheet, which is conveyed by the first conveyor 7 and the third conveyor 15, is moved along bold arrows (black arrows) in FIG. 2. The third conveyor 15 includes conveying guides 71, 73, a spur roller (rowel) 75 and pairs of conveying rollers 77, 78, 79.

The conveying guide 71 is fixed to the main frame 4, and extends in a right downward direction. The conveying guide 71 is aligned with the supporting surface 38 of the conveyor belt 37 of the first conveyor 7 when the first conveyor 7 takes the second angular posture. The conveying guide 71 serves to guide the sheet (conveyed by the first conveyor 7 when the first conveyor 7 takes the second angular posture) further in the right downward direction.

The conveying guide 73 is fixed to the main frame 4, and includes a rightwardly extending portion and an upwardly extending portion extending from the rightwardly extending portion. The rightwardly extending portion extends rightwardly from a right lower end portion of the conveying guide 71. The upward extending portion extends curvedly in an upward direction. The conveying guide 73 serves to guide the sheet that has been guided by the conveying guide 71. The third conveyance path, along which the sheet is to be conveyed by the third conveyor 15, is defined by cooperation of the guides 71, 73.

The spur roller 75 is disposed on halfway of the conveying guide 71, and has a sharp-toothed surface as its outer circumferential surface. The spur roller 75 is rotatably held by the main frame 4. Even if the sheet (that is conveyed by the first conveyor 7 when the first conveyor 7 takes the second angular posture) is brought into contact at its leading end portion with the spur roller 75, the conveyance of the sheet is not impeded by resistance applied to the sheet, because the resistance is reduced by rotation of the spur roller 75. Further, although the spur roller 75 is brought into contact at its outer circumferential surface with a recorded surface of the sheet, there is substantially no risk that an image recoded on the recorded surface of the sheet is damaged by the spur roller 75, because the outer circumferential surface of the spur roller 75 is the sharp-toothed surface. It is notated that the spur roller 75 may be either a driven roller or a drive roller that is to be rotated by a motor. It is further noted that the spur roller 75 is not essential and may not be provided.

The pairs of conveying rollers 77, 78, 79 are rotatably held by the main frame 4, and are disposed on halfway of the conveying guide 73. One of each of the pairs of conveying rollers 77, 78, 79 is a drive roller that is to be rotated by a motor (not shown) when the motor receives, from the controller 100, a command requesting of rotation of the drive roller. The other of each of the pairs of conveying rollers 77, 78, 79 is a driven roller that is to be rotated by rotation of the drive roller. The pairs of conveying rollers 77, 78, 79 serve to convey the sheet (that is being guided by the conveying guide 73) toward the sheet discharger 17.

<Sheet Discharger 17>

The sheet discharger 17 is configured to discharge the sheet (conveyed by the second conveyor 11 or the third conveyor 15) toward the sheet exit tray 3. The sheet discharger 17 includes a conveying guide 81 and pairs of conveying rollers 85, 87.

The conveying guide 81 is fixed to the main frame 4, and extends upwardly from a right end portion of the second conveyor 11 and an upper end portion of the third conveyor 15. The conveying guide 81 serves to guide the sheet (conveyed by the second conveyor 11 or third conveyor 15) in an upward direction.

The pairs of conveying rollers 85, 87 are rotatably held by the main frame 4, and are disposed on halfway of the conveying guide 81. One of each of the pairs of conveying rollers 85, 87 is a drive roller that is to be rotated by a motor (not shown) when the motor receives, from the controller 100, a command requesting of rotation of the drive roller. The other of each of the pairs of conveying rollers 85, 87 is a driven roller that is to be rotated by rotation of the drive roller. The pair of conveying roller 85, which are disposed on a lower side of the pair of conveying rollers 87, serve to convey the sheet (that is being guided by the conveying guide 81) upwardly toward the pair of conveying rollers 87. A sheet sensor 88 is disposed in vicinity of the pair of conveying rollers 85. The sheet sensor 88 is configured to detect the sheet conveyed from the second conveyor 11 or the third conveyor 15, and to supply, to the controller 100, a signal indicative of detection of the sheet. The pair of conveying rollers 87, which are disposed on an upper side of the pair of conveying rollers 85, are rotated in forward directions, when the sheet is to be discharged to the sheet exit tray 3, for thereby discharging the sheet (that has been guided by the conveying guide 81) to the sheet exit tray 3. On the other hand, when the sheet is to be guided to the return conveyor 19, the pair of conveying rollers 87 are first rotated in the above-described forward directions, and then rotated in reverse directions opposite to the forward directions with a trailing end portion of the sheet being nipped by the pair of conveying rollers 85 (disposed in vicinity of the sheet sensor 88), for thereby conveying the sheet to the return conveyor 19.

<Return Conveyor 19>

The return conveyor 19 is configured to convey the sheet from the sheet discharger 17 back to the first conveyor 7, along bold arrows (hatched arrows) in FIGS. 1 and 2. The return conveyor 19 includes conveying guides 73, 89 and pairs of conveying rollers 78, 79, 91. It is noted that the conveying guide 73 and the pairs of conveying rollers 78, 79 are common to the return conveyor 19 and the third conveyor 15.

The conveying guide 73 serves to guide the sheet (conveyed by the above-described opposite rotations of the pair of conveying rollers 87) to be moved in a left downward direction.

The conveying guide 89 is fixed to the main frame 4, and includes a leftwardly extending portion and an upwardly extending portion extending from the leftwardly extending portion. The leftwardly extending portion extends leftwardly from a junction of the conveying guides 71, 73. The upwardly extending portion extends curvedly in an upward direction, and reaches the conveying guide 29. Specifically, the upwardly extending portion of the conveying guide 89 is connected to a portion of the conveying guide 29 which is located below the pair of conveying rollers 31. The conveying guide 89 serves to guide the sheet (that has been guided by the conveying guide 73 by the rotations of the conveying rollers 87 in the reverse directions) toward the conveying guide 29.

The pair of conveying rollers 78, 79 serve to convey the sheet (that is conveyed by the rotations of the conveying rollers 87 in the reverse directions) toward the conveying guide 88.

The pair of conveying rollers 91 are fixed to the main frame 4, and are disposed on halfway of the conveying guide 89. One of the conveying rollers 91 is a drive roller that is to be rotated by a motor (not shown) when the motor receives, from the controller 100, a command requesting rotation of the drive roller. The other of the conveying rollers 91 is a driven roller that is to be rotated together with rotation of the drive roller. The pair of conveying rollers 91 serve to convey the sheet that is being guided by the conveying guide 29, toward the conveying guide 29.

<Posture Changer 21>

The posture changer 21 is configured to change the angular posture of each of the first conveyor 7 and the first recording head 9, by pivoting the first supporter 93. As shown in FIG. 4, the posture changer 21 includes the above-described forcing portion 101 and a drive mechanism 95 configured to pivot the first supporter 93.

The forcing portion 101 is constituted by a spring that is interposed between the contact portion 99 of the first supporter 93 and the support plate 109 that is formed integrally with the main frame 4. A lower end portion of the spring is fixed to the contact portion 99 while an upper end portion of the spring is fixed to the support plate 109. The spring has a length which is larger than a distance between the support plate 109 and the contact portion 99. More specifically, the spring has a natural length which is larger than the distance between the support plate 109 and the contact portion 99 not only when the first conveyor 7 takes the first angular posture but also when the first conveyor 7 takes the second angular posture. Thus, the spring is being compressed while being interposed between the support plate 109 and the contact portion 99. The forcing portion 101 is configured to force the contact portion 99 in a downward direction. With the contact portion 99 being forced downwardly by the forcing portion 101, the first supporter 93 can be reliably pivoted by rotation of the eccentric cam 111.

As shown in FIG. 4, the drive mechanism 95 includes, in addition to the eccentric cam 111, a motor 114 and three gears 115, 116, 117.

The eccentric cam 111 is rotatably held by the main frame 4, and is rotatable about a center of rotation which is offset from a gravitational center or a geometric center of the eccentric cam 111. The center of rotation of the eccentric cam 111 is located on a right side of the axis of the belt pulley 33. The eccentric cam 111 has an outer circumferential surface serving as a cam surface, and an upper portion of the outer circumferential surface of the cam 111 is held in contact with a lower surface 102 of the contact portion 99.

The gear 115 serves to transmit rotation of the motor 114, which is rotated when the motor 114 receives, from the controller 100, a command requesting of rotation of the motor 114. The gear 116 meshes with the gear 115. The gear 117 meshes with the gear 116, and is rotatable together with the eccentric cam 111. The gear 117 and the eccentric cam 111 are both fixed to a rotary shaft that is rotatably held by the main frame 4. That is, the gear 117 and the eccentric cam 111 are rotatable about the same axis. With the motor 114 being rotated, the rotation of the motor 114 is transmitted via the three gears 115, 116, 117 to the eccentric cam 111 whereby the cam 111 is rotated. The three gears 115, 116, 117 are rotatably held by the main frame 4. The motor 114 is fixed to the main frame 4.

With the eccentric cam 111 being rotated, a height of the upper portion of the outer circumferential surface of the cam 111 is changed. As a result of change of the height of the upper portion of the outer circumferential surface of the cam 111, a height of the contact portion 99 is changed. As a result of change of the height of the contact portion 99, an entirety of the first supporter 93 is pivoted about the axis of the belt pulley 33.

As described above, with the first supporter 93 being pivoted by the posture changer 21, the angular postures of the first conveyor 7 and the first recording head 9 are changed. When the first conveyor 7 takes the first angular posture, the supporting surface 38 of the conveyor belt 37 is made substantially flush with the supporting surface 60 of the conveyor belt 59. That is, when the first conveyor 7 takes the first angular posture, the first conveyance path is directed to the second conveyance path defined by the second conveyor 11, such that the first conveyance path is aligned with the second conveyance path without a step between the first and second conveyance paths. On the other hand, when the first conveyor 7 takes the second angular position, the supporting surface 38 of the conveyor belt 37 is made substantially flush with the conveying guide 72. That is, when the first conveyor 7 takes the second angular position, the first conveyance path is directed to the third conveyance path defined by the third conveyor 15, such that the first conveyance path is aligned with the third conveyance path without a step between the first and third conveyance paths.

<Recording Operation>

There will be described a both-side color recording and a both-side monochrome recording which are to be performed in the inkjet printer 1. It is noted that an one-side color recording and an one-side monochrome recording will not be described in detail, since the one-side recording is different from the both-side recording, merely in that a sheet is discharged to the sheet exit tray 3 when the recording has been performed onto one-side surface of the sheet.

When the controller 100 receives, from PC (personal computer), recording data representing color images that are to be recorded onto both-side faces of a sheet, the controller 100 controls the drive mechanism 95 such that the first conveyor 7 takes the first angular posture as shown in FIG. 1.

The controller 100 controls the sheet supplying roller 27 and the pair of conveying rollers 31 such that the sheet is conveyed from the sheet supplying cassette 23 to the first conveyor 7 via the conveying guide 29.

The controller 100 controls the first conveyor 7 such that the sheet is conveyed in a rightward direction while being attracted to the conveyor belt 37. More precisely described, the controller 100 controls the first conveyor 7 such that the attraction generating device causes, even before the sheet reaches the conveyor belt 37, the outer circumferential surface of the conveyor belt 37 to have an attraction force by which the sheet is attracted onto the outer circumferential surface of the conveyor belt 37. In this instance, since the first conveyor 7 takes the first angular posture, the supporting surface 38 of the conveyor belt 37 is parallel to a horizontal plane, so that the sheet conveyed by the conveyor belt 37 is moved along the horizontal plane in the rightward direction. When a leading end portion of the sheet reaches the sheet sensor 44, the sheet sensor 44 supplies, to the controller 100, a signal indicative of detection of the sheet by the sheet sensor 44. The controller 100 controls the first recording head 9 such that ink is ejected from the first recording head 9 when the sheet passes a region that is opposed to the first recording head 9, namely, when a given length of time has passed from the detection of the leading end portion of the sheet by the sheet sensor 44.

Then, the controller 100 controls the second conveyor 11, such that the sheet (conveyed to the second conveyor 11 via the conveying guide 67) is conveyed by the second conveyor 11 in the rightward direction while being attracted to the conveyor belt 59. The controller 100 controls the second recording heads 13 such that inks are ejected from the second recording heads 13 when the sheet passes a region that is opposed to the second recording heads 13, namely, when a given length of time has passed from the detection of the leading end portion of the sheet by the sheet sensor 44. The sheet is opposed to the nozzle opening surfaces 45, 69 of the first and second recording heads 9, 13 while being conveyed by the first and second conveyors 7, 11, and color image is recorded in a desired portion of a top surface of the sheet.

Then, the controller 100 controls the pairs of conveying rollers 85, 87 such that the sheet (conveyed by the conveyor belt 59) is conveyed toward the sheet exit tray 3 via the conveying guide 81. When a trailing end portion of the sheet reaches the sheet sensor 88, the sheet sensor 88 supplies, to the controller 100, a signal indicative of detection of the trailing end portion of the sheet by the sheet sensor 88. When having received the detection signal supplied from the sheet sensor 88, the controller 100 controls the pair of conveying rollers 87 such that directions of the rotations of the conveying rollers 87 are switched from the forward directions to the reverse directions.

Then, the controller 100 controls the pairs of conveying rollers 79, 78, 91 such that the sheet (conveyed by the reverse rotations of the pair of conveying rollers 87) is conveyed back to the pair of conveying rollers 31 via the conveying guides 73, 89. When reaching the pair of conveying rollers 31, the sheet has been inverted whereby the top and bottom faces of the sheet are caused to face downwardly and upwardly, respectively. Then, the controller 100 controls the pair of conveying rollers 31 such that the inverted sheet is conveyed to the first conveyor 7.

Then, the controller 100 controls the first conveyor 7, first recording head 9, second conveyor 11 and second recording heads 13 in a same manner as when the color image has been recorded on the top face of the sheet, such that a desired color image is recorded on the bottom face of the sheet. Then, the controller 100 controls the pair of conveying rollers 87 such that the sheet having the images recoded on its top and bottom faces is discharged to the sheet exit tray 3. Thus, the both-side color recording is completed.

In a case where monochrome images are to recoded onto both-side faces of a sheet, when the controller 100 receives, from PC (personal computer), recording data representing the monochrome images that are to be recorded onto the both-side faces of the sheet, the controller 100 controls the drive mechanism 95 such that the first conveyor 7 takes the second angular posture as shown in FIG. 2.

The controller 100 controls the sheet supplying roller 27 and the pair of conveying rollers 31 such that the sheet is conveyed from the sheet supplying cassette 23 to the first conveyor 7 via the conveying guide 29.

The controller 100 controls the first conveyor 7 such that the sheet is conveyed in a rightward direction while being attracted to the conveyor belt 37. In this instance, since the first conveyor 7 takes the second angular posture, the supporting surface 38 of the conveyor belt 37 is inclined with respect to a horizontal plane, so that the sheet conveyed by the conveyor belt 37 is moved in a right downward direction. The controller 100 controls the first recording head 9 such that ink is ejected from the first recording head 9 when the sheet passes a region that is opposed to the first recording head 9, namely, when a given length of time has passed from the detection of the leading end portion of the sheet by the sheet sensor 44.

Then, the controller 100 controls the pairs of conveying rollers 78, 79, 85, 87 such that the sheet (conveyed by the first conveyor 7) is conveyed by the third conveyor 15 toward the sheet exit tray 3. The sheet is opposed to the nozzle opening surface 45 of the first recording head 9, while being conveyed by the first conveyor 7, and monochrome image is recorded in a desired portion of a top surface of the sheet. When having received the detection signal supplied from the sheet sensor 88, the controller 100 controls the pair of conveying rollers 87 such that directions of the rotations of the conveying rollers 87 are switched from the forward directions to the reverse directions.

Then, the controller 100 controls the pairs of conveying rollers 79, 78, 91 such that the sheet is conveyed to the pair of conveying rollers 31 via the conveying guides 73, 89. When reaching the pair of conveying rollers 31, the sheet has been inverted whereby the top and bottom faces of the sheet are caused to face downwardly and upwardly, respectively. Then, the controller 100 controls the pair of conveying rollers 31 such that the inverted sheet is conveyed to the first conveyor 7.

Then, the controller 100 controls the first conveyor 7, first recording head 9 and third conveyor 15 in a same manner as when the monochrome image has been recorded on the top face of the sheet, such that a desired monochrome image is recorded on the bottom face of the sheet. Then, the controller 100 controls the pairs of conveying rollers 78, 79, 85, 87 such that the sheet having the images recoded on its top and bottom faces is discharged to the sheet exit tray 3. Thus, the both-side monochrome recording is completed.

During both-side monochrome recording, the sheet is conveyed by the third conveyor 15 in place of the second conveyor 11. That is, during the both-side monochrome recording, the sheet is conveyed along the third conveyance path which is defined by the third conveyor 15 and which is other than the second conveyance path defined by the second conveyor 11. Therefore, it is possible to restrain foreign substances such as paper dust from adhering onto the nozzle opening surfaces 69 of the second recording heads 13 which are opposed to the conveyor belt 59 of the second conveyor 11. Since the adhesion of the foreign substances to the nozzle opening surfaces 69 of the second recording heads 13 can be restrained, it is possible to reduce the number of times at which maintenance operations (such as flushing and purging operations for ejecting ink through nozzles for cleaning purpose) are required to be carried out. Consequently, it is possible to save an amount of ink that is be consumed in the maintenance operations. It is noted that, when the first conveyor 7 takes the second angular posture, the nozzle opening surfaces 69 of the respective second recording heads 13 may be closed by, for example, an annular-shaped cap (not shown) which is to be disposed to surround periphery of the set of second recording heads 13 and which is to be brought into contact with the supporting surface 60 of the conveyor belt 59, so that the nozzle opening surfaces 69 of the second recording heads 13 are covered by cooperation of the annular-shaped cap and the supporting surface 60. Owing to this arrangement with the annular-shaped cap, the required number of times of the maintenance operations can be further reduced.

<Effects of the First Embodiment>

In the above embodiment, the angular posture of the first conveyor 7, which applies a conveying force to the sheet while attracting the sheet thereto, is changed whereby the angular posture of the first conveyor 7 is changed between the first angular posture and the second angular posture. When the first conveyor 7 takes the first angular posture, as shown in FIG. 1, the supporting surfaces 38, 60 of the conveyor belts 37, 59 are substantially flush with each other, so that a conveyance path interconnecting the first and second conveyors 7, 11 (i.e., interconnecting the first and second conveyance paths) is not substantially bent or curved. Therefore, the sheet can be conveyed from the first conveyor 7 to the second conveyor 11, without the sheet receiving a large convey resistance, which is a force applied to the sheet and acting in a direction opposite to the conveyance direction. Since a large convey resistance is not applied to the sheet, a velocity of the conveyed sheet is not momentarily reduced by a large amount. Therefore, even if the recording is being carried out by the first recording head 9 when the sheet is conveyed from the first conveyor 7 to the second conveyor 11, it is possible to avoid deterioration of quality of the recoded image, which could be caused if the velocity of the conveyed sheet were momentarily reduced by a large amount.

On the other hand, when the first conveyor 7 takes the second angular position, the supporting surface 38 of the conveyor belt 37 is inclined so as to extend in a right downward direction, whereby the supporting surface 38 is made substantially flush with the conveying guide 72 so that a conveyance path interconnecting the first conveyor 7 and third conveyor 15 (i.e., interconnecting the first and third conveyance paths) is not substantially bent or curved. Further, since the conveyor belt 37 attracts the sheet thereto while conveying the sheet, the sheet is attracted onto the supporting surface 38 of the conveyor belt 37, so that the sheet can be reliably conveyed by the conveyor belt 37, although the supporting surface 38 of the conveyor belt 37 constitutes a downslope surface, i.e., a slope surface that is inclined such that the slope surface has a height that is reduced in the first conveyance direction. Further, since the sheet is conveyed from the first conveyor 7 to the third conveyor 11 without receiving a large convey resistance, the velocity of the conveyed sheet is not momentarily reduced by a large amount. Therefore, even if the recording is being carried out by the first recording head 9 when the sheet is conveyed from the first conveyor 7 to the third conveyor 15, it is possible to avoid deterioration of quality of the recoded image, which could be caused if the velocity of the conveyed sheet were momentarily reduced by a large amount.

According to the features of the first embodiment as described above, an increase of the size of the apparatus can be prevented, an amount of ink consumption can be reduced, and a reduction of the recorded image quality can be prevented.

If the angular posture of the first conveyor 7 were not changeable, a degree of curvature or bending of the conveyance path interconnecting the first and third conveyors 7, 15 cannot be reduced without increasing a distance between the first and third conveyors 7, 15, namely, without increasing a size of the apparatus as a whole. That is, the degree of curvature or bending of the conveyance path interconnecting the first and third conveyors 7, 15 would be increased where a reduction of the distance between the first and third conveyors 7, 15 is intended, namely, where a reduction of the size of the apparatus as a whole is intended. Further, in this arrangement in which the angular posture of the first conveyor 7 is not changeable, it might be possible to provide a pivotable flapper in a fork in which the first conveyance path is diverged into the second and third conveyance paths such that the sheet is conveyed from the first conveyor 7 to a selected one of the second conveyor 11 and third conveyor 15 which is selected depending on a posture of the pivotable flapper that does not apply a conveying force to the sheet. However, in this arrangement with the pivotable flapper, where the sheet is to be conveyed from the first conveyor 7 to the third conveyor 15, the direction of the conveyance is abruptly changed upon collision of the leading end of the sheet with the flapper. By the collision of the leading end of the sheet with the flapper, a large convey resistance is momentarily applied to the sheet, whereby the velocity of the conveyed sheet is momentarily reduced by a large amount, so that the image recorded by the first recording head 9 could be disordered.

In the above-described first embodiment, the first supporter 93 is pivotable about the axis of the belt pulley 33, so that a position of the belt pulley 33 is not changed irrespective of whether the first conveyor 7 takes the first angular posture or second angular posture. Therefore, irrespective of the angular posture of the first conveyor 7, the sheet (conveyed by the sheet supplier 5) can be stably conveyed by the conveyor belt 37 after having reached the conveyor belt 37.

In the above-described first embodiment, the first supporter 93 is pivotable by rotation of the eccentric cam 111. Described specifically, the height of the contact portion 99 of the first supporter 93 is dependent on the height of the upper surface of the eccentric cam 111, and the first supporter 93 supporting the first conveyor 7 is pivotable. That is, the first supporter 93 is positioned in a position that is dependent on the height of the upper surface of the eccentric cam 111, the positioning of the first supporter 93 can be made accurately. Further, the forcing portion 101 is provided to force the contact portion 66 in a direction toward the upper surface of the eccentric cam 111, so that the pivot motion of the first supporter 93 can be reliably linked to the rotation of the eccentric cam 111.

<Modifications of First Embodiment>

In the above-described first embodiment, the first conveyor 7 includes a single conveyor unit in the form of the belt conveyor unit 6 that is configured to cause a sheet to be attracted onto the supporting surface 38 of the conveyor belt 37 and to convey the sheet. However, this arrangement is not essential. For example, the first conveyor 7 may include, in place of the belt conveyor unit 6, pairs of conveying rollers and a platen for supporting a sheet, wherein the pairs of conveying rollers are disposed on upstream and downstream sides of the first recording head 9, and wherein the platen is disposed to be opposed to the nozzle opening surface 45 of the first recording head 9. In this modification, the first conveyor 8 may include an attraction generating device that is provided for the platen, for causing a sheet to be attracted onto a supporting surface of the platen. As the attraction generating device, it is possible to employ a pair of comb-teeth-like electrodes as disclosed, for example, in JP-H07-330185A. The comb-teeth-like electrodes are spaced apart from each other by a given distance, for avoiding a short connection between the electrodes. Each of the comb-teeth-like electrodes has a plurality of elongated portions which are elongated in the right-left direction and which are arranged in the front-rear direction. With application of an electric voltage between the comb-teeth-like electrodes, an attraction force based on a static electricity can be generated on the supporting surface of the platen.

In the above-described first embodiment, the second conveyor 11 includes a single conveyor unit in the form of the belt conveyor unit 12 that is configured to cause a sheet to be attracted onto the supporting surface 60 of the conveyor belt 59 and to convey the sheet. However, this arrangement is not essential. For example, the second conveyor 11 may include, in place of the belt conveyor unit 12, pairs of conveying rollers and a platen for supporting a sheet, wherein the pairs of conveying rollers are disposed on upstream and downstream sides of the set of second recording heads 13, and wherein the platen is disposed to be opposed to the nozzle opening surfaces 69 of the respective second recording heads 13. In this modification, the second conveyor 11 may not include an attraction generating device configured to cause a sheet to be attracted onto a supporting surface of the platen.

In the above-described first embodiment, the belt conveyor unit 6 includes the attraction generating device which is constituted by the belt pulley 33, first charge roller 41 and first direct-current source 43 and which is configured to provide the conveyor belt 37 with the attraction force that is generated based on a static electricity. Further, the belt conveyor unit 12 includes the attraction generating device which is constituted by the belt pulley 55, second charge roller and second direct-current source and which is configured to provide the conveyor belt 59 with the attraction force that is generated based on a static electricity. However, these arrangements are not essential. For example, a pair of comb-teeth-like electrodes may be disposed on a surface of each of the platens 40, 63 which is in contact with a corresponding one of the conveyor belts 37, 59, wherein the comb-teeth-like electrodes are spaced apart from each other by a given distance, for avoiding a short connection between the electrodes. Each of the comb-teeth-like electrodes has a plurality of elongated portions which are elongated in the right-left direction and which are arranged in the front-rear direction. With application of an electric voltage between the comb-teeth-like electrodes, an attraction force based on a static electricity can be generated in the conveyor belts 37, 59. In this modification, the belt conveyor units 6, 12 do not have to include the first charge roller 41 and second charge roller, respectively.

In the above-described first embodiment, each of the conveyor belts 37, 59 is given the attraction force based on the static electricity, whereby a sheet is caused to be attracted onto a corresponding one of the supporting surfaces 38, 60. However, this arrangement is not essential. For example, each of the conveyor belts 37, 59 may be constituted by a belt having self-bonding properties, so that a sheet can be attracted to the belt owing to the self-bonding properties. Further, as another example, a sucking device may be provided for sucking air through holes that are formed through the conveyor belts 37, 59, for thereby enabling a sheet to be attracted to the conveyor belts 37, 59, owing to a sucking force that is generated by the sucking device.

In the above-described first embodiment, the conveyor belts 37, 59 are stretched around the belt pulleys 33, 35, 55, 57, and the upstream-side belt pulleys 33, 55 serve as drive rollers. However, the downstream-side belt pulleys 35, 57, in place of the upstream-side belt pulleys 33, 55, may serve as drive rollers.

In the above-described first embodiment, when the first conveyor 7 takes the first angular posture, the supporting surfaces 38, 60 of the respective conveyor belts 37, 59 are substantially flush with each other. However, in this instance, the second conveyor 11 may be located either on an upper side or a lower side of the first conveyor 7. In this modification, too, the first angular posture of the first conveyor 7 is an angular posture of the first conveyor 7 by which the first conveyance path (defined by the supporting surface 38 of the conveyor belt 37) is directed to the second conveyance path (defined by the supporting surface 60 of the conveyor belt 59). Further, in the above-described first embodiment, the third conveyor 15 is located on a lower side of the first conveyor 7. However, the third conveyor 15 may be located on an upper side of the first conveyor 7 or located in the same height position as the first conveyor 7. In this modification, too, the second angular posture of the first conveyor 7 is an angular posture of the first conveyor 7 by which the first conveyance path (defined by the supporting surface 38 of the conveyor belt 37) is directed to the third conveyance path (defined by the conveying guides 71, 73). It is noted that, where the third conveyor 15 is located in the same height position as the first conveyor 7, the supporting surface 38 of the conveyor belt 37 is substantially flush with the conveying guides 71, 73.

In the above-described first embodiment, the first recording head 9 is a black recording head that is configured to eject black ink in a monochrome recording. However, for example, the first recording head 9 may be a color recording head that is configured to eject color inks in a color recording. Further, as another example, the first recording head 9 may be configured to eject liquid other than ink. Such a liquid may be a liquid that is to be ejected toward a sheet in a pre-recording operation that is to be carried out, prior to ejection of the ink, for the purpose of facilitating fixation of the ink onto the sheet or increasing color-developing properties of the ink.

In the above-described first embodiment, the set of second recording heads 13 consist of three color recording heads that are configured to eject magenta, cyan and yellow inks. However, for example, the set of second recording heads 13 may consist of four or more recording heads including a recording head that is configured to eject the other color ink such as light magenta and light cyan inks. Further, as another example, the second recording heads 13 may be a black recording head that is configured to eject black ink in a monochrome recording. Still further, the second recording heads 13 may be configured to eject liquid other than ink. Such a liquid may be a liquid that is to be ejected toward a sheet in a post-recording operation that is to be carried out, after ejection of the ink, for the purpose of facilitating fixation of the ink onto the sheet or increasing color-developing properties of the ink.

In the above-described first embodiment, the first supporter 93 is constructed to support the first conveyor 7 and the first recording head 9. However, the first supporter 93 may be constructed to support only the first conveyor 7, as long as the first recording head 9 is supported by another member. In this modification, the angular posture of the first recording head 9 is changed such that the nozzle opening surface 45 of the first recording head 9 and the supporting surface 38 of the conveyor bet 37 are opposed to each other and are spaced apart from each other by a distance that is constant irrespective of change of the angular posture of the first conveyor 7.

In the above-described first embodiment, the first supporter 93 is constructed to support the belt conveyor unit 6 except the first charge roller 41. However, the first supporter 93 may be construed to support the entirety of the belt conveyor unit 6 including the first charge roller 41. Further, the first supporter 93 does not have to support all or many of the components of the belt conveyor unit 6, as long as the first supporter 93 supports at least the belt pulleys 33, 35.

In the above-described first embodiment, the posture changer 21 is constructed to cause the first conveyor 7 and the first recording head 9 to be pivoted by rotation of the eccentric cam 111. However, the posture changer 21 may be otherwise constructed, as long as it is capable of causing the first conveyor 7 and the first recording head 9 to be pivoted together with each other. For example, the first supporter 93 may be provided with a rack that extends in a vertical direction while the drive mechanism 95 may be provided with a drive transmission mechanism and a pinion meshing with the rack, such that, for example, the first supporter 93 provided with the rack is pivotable, by rotation of the pinion, about the axis of the belt pulley 33.

In the above-described first embodiment, the posture changer 21 includes the forcing portion 101. However, the posture changer 21 may not include the forcing portion 101. Further, in the first embodiment, the upper portion of the eccentric cam 111 is held in contact with the lower surface 102 of the contact portion 99. However, the eccentric cam 111 and the contact portion 99 may be arranged such that a lower portion of the eccentric cam 111 is held in contact with an upper surface of the contact portion 99. In this modification, too, the contact portion 99 is forced by a forcing portion in a direction toward the eccentric cam 111.

In the above-described first embodiment, when the controller 100 receives recording data representing color images that are to be recorded onto both-side faces of a sheet, the controller 100 controls the drive mechanism 95 such that the first conveyor 7 takes the first angular posture. In this instance, the controller 100 may control the drive mechanism 95 such that the first conveyor 7 becomes to take the first angular posture before the sheet reaches the first conveyor 7. Further, in the above-described first embodiment, when the controller 100 receives recording data representing monochrome images that are to be recorded onto both-side faces of a sheet, the controller 100 controls the drive mechanism 95 such that the first conveyor 7 takes the second angular posture. In this instance, the controller 100 may control the drive mechanism 95 such that the first conveyor 7 becomes to take the second angular posture before the sheet reaches the first conveyor 7. Further, when the controller 100 receives recording data representing color image and monochrome image that are to be recorded onto one and the other of both-side faces of a sheet, respectively, the controller 100 may control the drive mechanism 95, such that the first conveyor 7 takes the first angular position for recording of the color image onto the one of the both-side faces of the sheet, and such that the first conveyor 7 takes the second angular position for recording of the monochrome image onto the other of the both-side faces of the sheet. That is, the controller 100 may control the drive mechanism 95 such that the first conveyor 7 takes the first angular posture when color-image is to be recoded onto a sheet, and such that the first conveyor 7 takes the second angular posture when monochrome-image is to be recoded onto a sheet.

[Second Embodiment]

Figure 6:
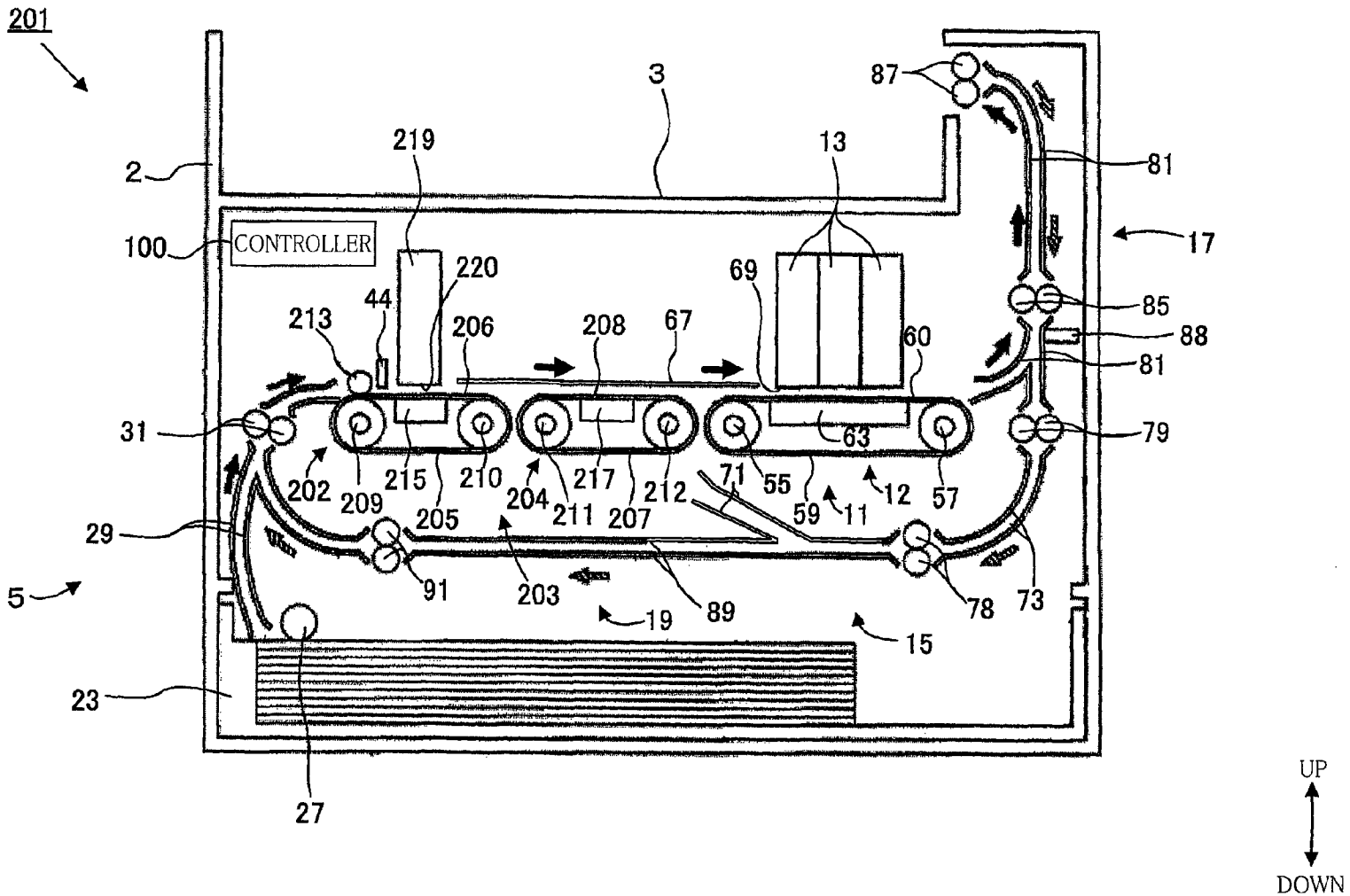
FIG. 6 is a schematic side view of an internal construction of an inkjet printer 201 according to a second embodiment of the invention, showing a state in which a belt conveyor unit 204 takes a first angular posture.
Figure 7:
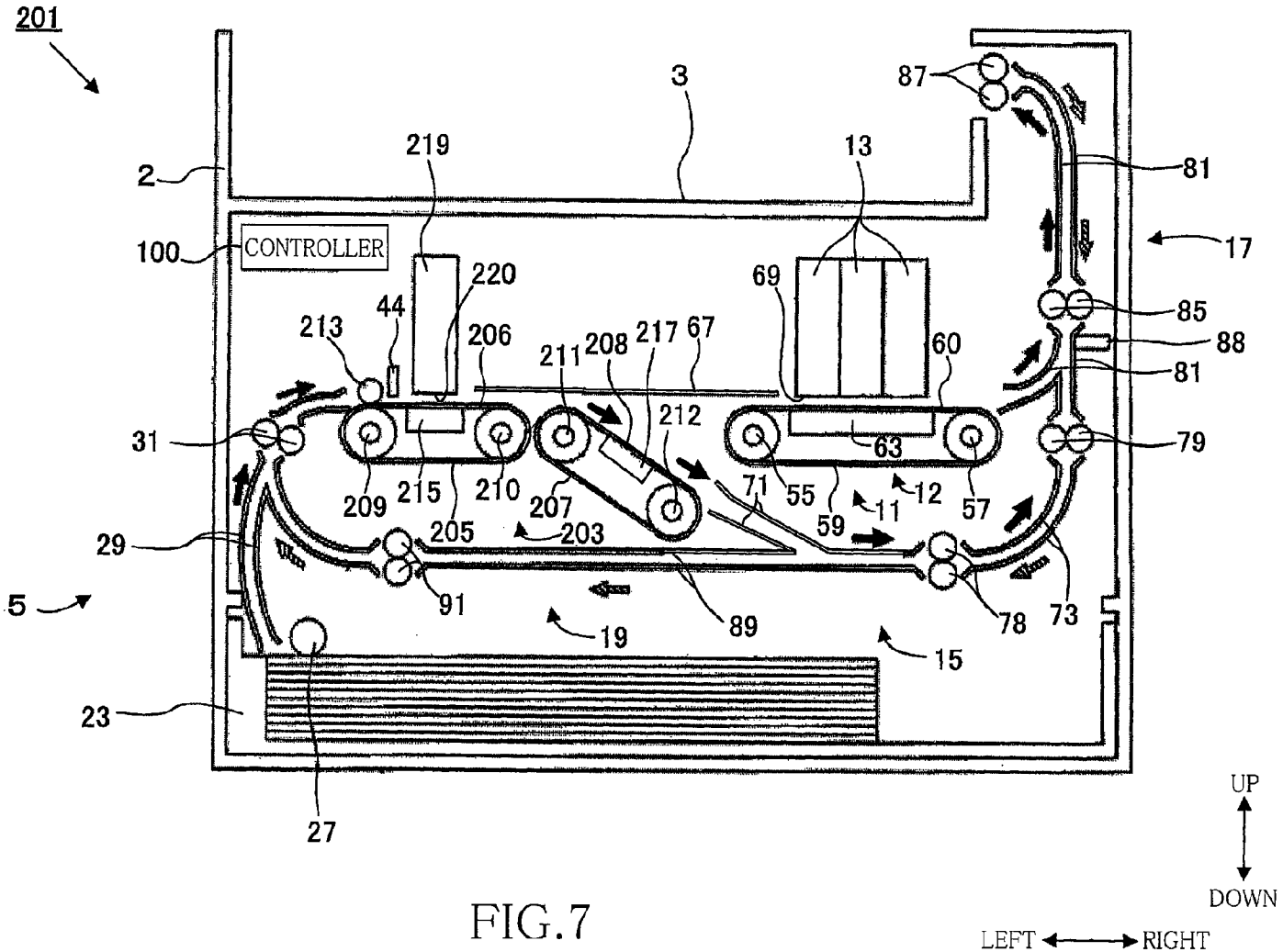
FIG. 7 is a schematic side view of the internal construction of the inkjet printer 201, showing a state in which the belt conveyor unit 204 takes a second angular posture.

Referring next to FIGS. 6 and 7, there will be described an inkjet printer 201 that is constructed according to a second embodiment of the invention. In the following description regarding this second embodiment, the same reference numerals as used in the first embodiment will be used to identify the same or similar elements, and redundant description of these elements will not be provided.

In the inkjet printer 201, a first conveyor 203 has a construction different from that of the first conveyor 7 of the inkjet printer 1 of the first embodiment. Due to the difference of the first conveyor 203 from the first conveyor 7 of the inkjet printer 1 of the first embodiment, the first supporter 93 and the conveying guides 67, 71 in this second embodiment are slightly different from those in the first embodiment with respect to construction. However, the same reference numerals will be used for these elements since they are substantially the same as those in the first embodiment.

<First Supporter 93>

The first supporter 93 supports a belt conveyor unit 204 that will be described later in detail. As in the first embodiment, the first supporter 93 is pivotable by the posture changer 21. The walls 103, 104 of the first supporter 93 have through-holes (not shown) in which shafts of respective belt pulleys 211, 212 are introduced. The shaft of the belt pulley 211 is introduced in the through-holes of the respective walls 103, 104 and also in a through-hole of the main frame 4, so that the first supporter 93 is pivotable about the axis of the belt pulley 211.

The walls 105, 106 are plate-like members extending and interconnecting the walls 103, 104. In the first embodiment, the first recording head 9 is sandwiched by the walls 105, 106 from the left and right sides. However, in the second embodiment, the walls 105, 106 are not disposed in respective positions for sandwiching the first recording head 9.

<First Conveyor 203>

As shown in FIG. 6, the first conveyor 203 is configured to convey the sheet (conveyed by the sheet supplier 5) in the rightward direction. The first conveyor 203 includes two belt conveyor units 202, 204 which are arranged in the right-left direction.

The belt conveyor unit 202 includes belt pulleys 209, 210, a conveyor belt 205, a platen 215, a pressing roller 213 and a third charge roller (not shown). Since the belt conveyor unit 202 has a construction substantially the same as those of the belt conveyor units 6, 12 in the first embodiment, redundant description of the belt conveyor unit 202 will not be provided. The belt pulleys 209, 210 are both positioned in the same height position as the belt pulley 55. The belt conveyor unit 202 is held by the main frame 4, and is configured to convey the sheet (which is held on a supporting surface 206 constituted by an upper portion of an outer circumferential surface of the conveyor belt 205) in the rightward direction.

The belt conveyor unit 204 includes belt pulleys 211, 212, a conveyor belt 207, a platen 217 and a fourth charge roller (not shown). Since the belt conveyor unit 204 has a construction substantially the same as those of the belt conveyor units 6, 12 in the first embodiment, redundant description of the belt conveyor unit 204 will not be provided. The belt conveyor unit 204 does not include a pressing roller that is to serve to press the sheet down onto the outer circumferential surface of the conveyor belt 207. The belt conveyor unit 204 is supported by the first supporter 93, like the belt conveyor unit 6 in the first embodiment. Describe specifically, the shaft of the belt pulley 211 is introduced in the through-holes of the walls 103, 104 of the first supporter 93 and also in the through-hole of the main frame 4. By pivot motion of the first supporter 93, the posture of the first conveyor 204 is changed between the first angular posture and the second angular posture.

In this second embodiment, the angular posture of only the belt conveyor unit 204, which is a right-side one, i.e., downstream-side one of the two belt conveyor units 202, 204, is changeable between the first angular posture and the second angular posture. That is, in the second embodiment, the angular posture of the belt conveyor unit 204, which corresponds to a downstream-side portion of the first conveyor 203, is changeable, while the angular posture of the entirety of the first conveyor 7 is changeable in the above-described first embodiment.

When the belt conveyor unit 204 takes the first angular posture as shown in FIG. 6, the belt pulley 212 is positioned in the same height position as the belt pulley 211, and a supporting surface 208 (which is an upper-side surface provided by an upper portion of the outer circumferential surface of the conveyor belt 207) is parallel to a horizontal plane. Thus, the sheet conveyed by the conveyor belt 207 is moved along the horizontal plane in the rightward direction. That is, when the belt conveyor unit 204 takes the first angular posture, the sheet, which is conveyed by the first conveyor 203, is moved in the rightward direction while being supported on the supporting surface 206 of the conveyor belt 205 and is then moved further in the rightward direction while being supported on the supporting surface 208 of the conveyor belt 207.

On the other hand, when the belt conveyor unit 204 takes the second angular posture as shown in FIG. 7, the belt pulley 212 is positioned in a position lower than the belt pulley 211, and the supporting surface 208 of the conveyor belt 207 is inclined with respect to a horizontal plane, in a right downward direction. Thus, the sheet conveyed by the conveyor belt 207 is moved in the right downward direction, while being supported on the supporting surface 208 of the conveyor belt 207. That is, when the belt conveyor unit 204 takes the second angular posture, the sheet, which is conveyed by the first conveyor 203, is moved in the rightward direction while being supported on the supporting surface 206 of the conveyor belt 205 and is then moved in the right downward direction while being supported on the supporting surface 208 of the conveyor belt 207. In this second embodiment, the first conveyance path defined by the first conveyor 203 includes an upstream-side part defined by the supporting surface 206 of the conveyor belt 205 and a downstream-side part defined by the supporting surface 208 of the conveyor belt 207.

<First Recording Head 219>

The first recording head 219 is to be activated, when the first recording head 219 receives, from the controller 100, a command requesting of activation of the head 219, for thereby ejecting ink toward the sheet that is being conveyed by the conveyor belt 205 of the first conveyor 203.

The first recording head 219 is fixed to the main frame 4 such that a nozzle opening surface (i.e., ejection surface) 220 of the first recording head 219 and the supporting surface 206 of the conveyor belt 205 are opposed to each other and spaced apart from each other by a predetermined distance. The first recording head 219, which is fixed to the main frame 4, has a fixed posture that is not changeable.

<Posture Changer 21>

The posture changer 21 has the drive mechanism 95 that is configured to pivot the first supporter 93. The posture changer 21 is configured to cause the first supporter 93 to be pivoted about the axis of the belt pulley 211, thereby changing the posture of the belt conveyor unit 204 between the first angular posture and the second angular posture.

<Effects of the Second Embodiment>

In the above embodiment, the angular posture of the belt conveyor unit 204 as the downstream-side portion of the first conveyor 203, which applies a conveying force to the sheet while attracting the sheet thereto, is changed whereby the angular posture of the belt conveyor unit 204 is changed between the first angular posture and the second angular posture. When the belt conveyor unit 204 takes the first angular posture, as shown in FIG. 6, the supporting surfaces 206, 208, 60 of the three conveyor belts 205, 207, 59 are substantially flush with each other, so that a conveyance path interconnecting the first and second conveyors 203, 11 (i.e., interconnecting the first and second conveyance paths) is not substantially bent or curved. Therefore, the sheet can be conveyed from the first conveyor 203 to the second conveyor 11, without the sheet receiving a large convey resistance, which is a force applied to the sheet and acting in a direction opposite to the conveyance direction. Therefore, even if the recording is being carried out by the first recording head 219 when the sheet is conveyed from the first conveyor 203 to the second conveyor 11, it is possible to avoid deterioration of quality of the recoded image, which could be caused if the velocity of the conveyed sheet were momentarily reduced by a large amount.

On the other hand, when the belt conveyor unit 204 takes the second angular posture, as shown in FIG. 7, the supporting surface 208 of the conveyor belt 207 is inclined so as to extend in a right downward direction. Since the conveyor belt 207 attracts the sheet thereto while conveying the sheet, the sheet is attracted onto the supporting surface 208 of the conveyor belt 207, so that the sheet can be reliably conveyed by the conveyor belt 207, although the supporting surface 208 of the conveyor belt 207 constitutes a downslope surface, i.e., a slope surface that is inclined such that the slope surface has a height that is reduced in the first conveyance direction. That is, when the sheet is transferred from the conveyor belt 205 to the conveyor belt 207, the sheet is caused to be attracted onto the supporting surface 208 of the conveyor belt 207 upon arrival of the leading end portion of the sheet at the conveyor belt 207, so that the direction of conveyance the sheet is changed by the attraction of the sheet onto the supporting surface 208 of the conveyor belt 207. Therefore, as compared with an arrangement in which the direction of conveyance of the sheet is changed by a pivotable flapper that does not apply a conveying force to the sheet, it is possible to reduce the conveyance resistance applied to the sheet. In the arrangement with the pivotable flapper, the conveyance direction is abruptly changed upon collision of the leading end of the sheet with the flapper, thereby resulting in a large convey resistance that is momentarily applied to the sheet. However, in the present second embodiment in which the conveyance direction is changed owing to the attraction of the sheet onto the supporting surface 208 of the conveyor belt 207, a large convey resistance is not applied to the sheet.

In the present second embodiment, the direction of conveyance of the sheet is changed by the attraction of the leading end portion of the sheet onto the supporting surface 208 of the conveyor belt 207. Consequently, as compared with an arrangement with the pivotable flapper, the convey resistance applied to the sheet can be made smaller. Accordingly, even if the recording is being continuously carried out by the first recording head 219 when the sheet is conveyed from the first conveyor 203 to the second conveyor 11, it is possible to avoid deterioration of quality of the recoded image.

<Modifications of Second Embodiment>

In the above-described second embodiment, the first conveyor 203 includes two conveyor units in the form of the belt conveyor units 202, 204. However, this arrangement is not essential. For example, the first conveyor 203 may include, in place of the belt conveyor units 202, 204, pairs of conveying rollers and a platen for supporting a sheet. Further, in the above-described second embodiment, the conveyor belt 205 is configured to convey a sheet while causing the sheet to be attracted onto the supporting surface 206 of the conveyor belt 205. However, this arrangement is not essential.

In the above-described second embodiment, the belt conveyor units 202, 204 include attraction generating devices which are constituted by the belt pulleys 209, 211, first and second charge rollers and first and second direct-current sources and which are configured to provide the conveyor belts 205, 207 with the attraction forces each of which is generated based on a static electricity. However, this arrangements is not essential. For example, a pair of comb-teeth-like electrodes may be disposed on a surface of each of the platens 215, 217 which is in contact with a corresponding one of the conveyor belts 205, 207, wherein the comb-teeth-like electrodes are spaced apart from each other by a given distance, for avoiding a short connection between the electrodes. Each of the comb-teeth-like electrodes has a plurality of elongated portions which are elongated in the right-left direction and which are arranged in the front-rear direction. In this modification, with application of an electric voltage between the comb-teeth-like electrodes, an attraction force based on a static electricity can be generated in the conveyor belts 205, 207.

In the above-described second embodiment, each of the conveyor belts 205, 207 is given the attraction force based on the static electricity, whereby a sheet is caused to be attracted onto a corresponding one of the supporting surfaces 206, 208. However, this arrangement is not essential. For example, each of the conveyor belts 205, 207 may be constituted by a belt having self-bonding properties, so that a sheet can be attracted to the belt owing to the self-bonding properties. Further, as another example, a sucking device may be provided for sucking air through holes that are formed through the conveyor belts 205, 207, for thereby enabling a sheet to be attracted to the conveyor belts 205, 207, owing to a sucking force that is generated by the sucking device.

In the above-described second embodiment, the conveyor belts 205, 207 are stretched around the belt pulleys 209, 210, 211, 212, and the upstream-side belt pulleys 209, 211 serve as drive rollers. However, the downstream-side belt pulleys 210, 212, in place of the upstream-side belt pulleys 209, 211, may serve as drive rollers.

In the above-described second embodiment, there is not provided a pressing roller serving to press a sheet onto the outer circumferential surface of the conveyor belt 207. However, a freely rotatable roller may be provided as such a pressing roller. In this modification, although the sheet, which has been transferred from the conveyor belt 205 to the conveyor belt 207, is likely to collide at its leading end portion with the pressing roller, it is possible to restrain the convey resistance applied to the sheet because the pressing roller is constituted by a freely rotatable roller.

In the above-described second embodiment, when the conveyor belt 207 takes the first angular posture, the supporting surfaces 208, 60 of the respective conveyor belts 207, 59 are substantially flush with each other. However, in this instance, the second conveyor 11 may be located either on an upper side or a lower side of the conveyor belt 207. In this modification, too, the first angular posture of the first conveyor 7 is an angular posture of the conveyor belt 207 by which the first conveyance path (defined by the supporting surfaces 206, 208 of the respective conveyor belts 205, 207) is directed to the second conveyance path (defined by the supporting surface 60 of the conveyor belt 59). Further, in the above-described second embodiment, the third conveyor 15 is located on a lower side of the conveyor belt 207. However, the third conveyor 15 may be located on an upper side of the conveyor belt 207 or located in the same height position as the conveyor belt 207. In this modification, too, the second angular posture of the conveyor belt 207 is an angular posture of the conveyor belt 207 by which the first conveyance path (defined by the supporting surfaces 206, 208 of the respective conveyor belts 205, 207) is directed to the third conveyance path (defined by the conveying guides 71, 73). It is noted that, where the third conveyor 15 is located in the same height position as the conveyor belt 207, the supporting surface 208 of the conveyor belt 207 is substantially flush with the conveying guides 71, 73.

What is claimed is:

1. An image recording apparatus comprising:

a first conveyor configured to convey a recording medium along a first conveyance path which is defined by said first conveyor;

a first recording head configured to eject liquid toward the recording medium that is being conveyed by said first conveyor;

a second conveyor configured to convey the recording medium conveyed by said first conveyor, along a second conveyance path which is defined by said second conveyor;

a second recording head configured to eject liquid toward the recording medium that is being conveyed by said second conveyor;

a third conveyor configured to convey the recording medium conveyed by said first conveyor, along a third conveyance path which is defined by said third conveyor and which is other than the second conveyance path; and a posture changer configured to change a posture of at least a downstream-side portion of said first conveyor whereby said at least said downstream-side portion of said first conveyor is caused to take a selected one of a plurality of angular postures including a first angular posture and a second angular posture, such that at least a downstream-side part of the first conveyance path defined by said at least said downstream-side portion of said first conveyor is directed to the second conveyance path when said at least said downstream-side portion of said first conveyor takes the first angular posture, and such that said at least the downstream-side part of the first conveyance path is directed to the third conveyance path when said at least said downstream-side portion of said first conveyor takes the second angular posture.

2. The image recording apparatus according to claim 1, wherein said at least the downstream-side part of the first conveyance path is aligned with the second conveyance path, when said at least said downstream-side portion of said first conveyor takes the first angular posture, and wherein said at least the downstream-side part of the first conveyance path is aligned with third conveyance path, when said at least said downstream-side portion of said first conveyor takes the second angular posture.

3. The image recording apparatus according to claim 1, wherein said at least said downstream-side portion of said first conveyor is configured to apply a conveying force to the recording medium while attracting the recording medium thereto.

4. The image recording apparatus according to claim 3, wherein said at least said downstream-side portion of said first conveyor includes a conveyor belt having a supporting surface defines said at least the downstream-side part of the first conveyance path, said at least said downstream-side portion of said first conveyor being configured to convey the recording medium that is caused to adhere onto said supporting surface, and wherein said supporting surface of said conveyor belt constitutes a downslope surface, when said at least said downstream-side portion of said first conveyor takes the first angular posture and/or when said at least said downstream-side portion of said first conveyor takes the second angular posture.

5. The image recording apparatus according to claim 1, further comprising a supporter supporting said at least said downstream-side portion of said first conveyor, wherein said at least said downstream-side portion of said first conveyor includes an endless conveyor belt which is to support the recording medium held on an outer circumferential surface of said endless conveyor belt and which is to be circulated, for thereby conveying the recording medium, and wherein said posture changer is configured to change the posture of said at least said downstream-side portion of said first conveyor, by causing said supporter to be pivoted about an upstream-side portion of said endless conveyor belt.

6. The image recording apparatus according to claim 5, wherein said at least said downstream-side portion of said first conveyor further includes an attraction generating device configured to cause the recording medium to be attracted onto said outer circumferential surface of said endless conveyor belt.

7. The image recording apparatus according to claim 5, wherein said posture changer includes an eccentric cam, and wherein said supporter includes a contact portion which is held in contact with said eccentric cam, said supporter being pivotable about said upstream-side portion of said endless conveyor belt by rotation of said eccentric cam that is held in contact with said contact portion of said supporter.

8. The image recording apparatus according to claim 7, wherein said contact portion is located above said eccentric cam, and has a lower surface that is held in contact with an upper portion of said eccentric cam.

9. The image recording apparatus according to claim 7, wherein said posture changer includes a forcing portion forcing said contact portion in a direction toward said eccentric cam.

10. The image recording apparatus according to claim 1, wherein said posture changer is configured to change the posture of an entirety of said first conveyor whereby said entirety of said first conveyor is caused to take the selected one of the plurality of angular postures including the first angular posture and the second angular posture, such that an entirety of the first conveyance path defined by said entirety of said first conveyor is directed to the second conveyance path when said entirety of said first conveyor takes the first angular posture, and such that the entirety of the first conveyance path is directed to the third conveyance path when said entirety of said first conveyor takes the second angular posture.

11. The image recording apparatus according to claims 10, comprising a supporter supporting said entirety of said first conveyor, wherein said entirety of said first conveyor includes a single belt consisting of an endless conveyor belt which is to support the recording medium held on an outer circumferential surface of said endless conveyor belt and which is to be circulated, for thereby conveying the recording medium, wherein said posture changer is configured to change the posture of said entirety of said first conveyor, by causing said supporter to be pivoted about an upstream-side portion of said endless conveyor belt, and wherein said supporter supports said first recording head as well as said entirety of said first conveyor, such that an ejection surface of said first recording head is distant from said outer circumferential surface of said endless conveyor belt by a distance which is constant irrespective of change of the posture of said entirety of said first conveyor.

12. The image recording apparatus according to claim 1, wherein said posture changer is configured to change the posture of said downstream-side portion of said first conveyor whereby said downstream-side portion of said first conveyor is caused to take the selected one of the plurality of angular postures including the first angular posture and the second angular posture, such that the downstream-side part of the first conveyance path defined by said downstream-side portion of said first conveyor is directed to the second conveyance path when said downstream-side portion of said first conveyor takes the first angular posture, and such that the downstream-side part of the first conveyance path is directed to the third conveyance path when said downstream-side portion of said first conveyor takes the second angular posture.

13. The image recording apparatus according to claim 12, wherein said downstream-side portion of said first conveyor includes a single belt consisting of an endless conveyor belt, and wherein said first conveyor includes an upstream-side portion which is provided on an upstream side of said downstream-side portion, said upstream-side portion of said first conveyor being configured to convey the recording medium while causing the recording medium to be opposed to said first recording head.

* * * * *